US011170604B2

(12) United States Patent
Little

(10) Patent No.: US 11,170,604 B2
(45) Date of Patent: Nov. 9, 2021

(54) ELECTRONIC GAMING MACHINE WITH NON-ORTHOGONALLY ARRANGED REEL POSITIONS

(71) Applicant: Aristocrat Technologies Australia Pty Limited, North Ryde (AU)

(72) Inventor: David C. Little, Las Vegas, NV (US)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 439 days.

(21) Appl. No.: 16/022,634

(22) Filed: Jun. 28, 2018

(65) Prior Publication Data

US 2020/0005588 A1 Jan. 2, 2020

(51) Int. Cl.
*G07F 17/32* (2006.01)
*G07F 17/34* (2006.01)

(52) U.S. Cl.
CPC ..... *G07F 17/3213* (2013.01); *G07F 17/34* (2013.01)

(58) Field of Classification Search
CPC ..... G07F 17/3213; G07F 17/34
USPC ..... 463/20
See application file for complete search history.

(56) References Cited

U.S. PATENT DOCUMENTS 5,413,342 A 5/1995 Kaplan
5,598,523 A 1/1997 Fujita
D451,928 S 12/2001 Van Huong
6,413,162 B1 * 7/2002 Baerlocher ..... G07F 17/3202 273/143 R
D553,147 S 10/2007 Hally et al.
D562,345 S 2/2008 Ottaway
7,331,858 B2 2/2008 McComb et al.
7,382,378 B2 6/2008 Levene
D574,847 S 8/2008 O'Donnell
D588,607 S 3/2009 O'Donnell
D594,013 S 6/2009 Singh et al.
D601,158 S 9/2009 Rezende
8,216,051 B2 7/2012 Rasmussen
D698,819 S 2/2014 Gardner
D706,283 S 6/2014 Pedraza Padilla
(Continued)

OTHER PUBLICATIONS

"Triangulation Slot Review," YouTube. Video listed as published on Jul. 11, 2013, 3 pages of screen shots. Link: https://www.youtube.com/watch?v=yePAioRlWrg.

(Continued)

*Primary Examiner* — Dmitry Suhol
*Assistant Examiner* — Ryan Hsu
(74) *Attorney, Agent, or Firm* — Weaver Austin Villeneuve & Sampson LLP

(57) ABSTRACT

Gaming machines with that may provide non-orthogonally arranged patterns of reels are disclosed. Such reel arrangements may exhibit highest-order N-fold radial symmetry where N=3 or N≥5, and may feature groups of radially arrayed paylines. Due to the radial symmetry exhibited by such reel layouts or arrangements, a large number of paylines may be provided—far more than may feasibly be implemented on traditional, quadrilateral-format slot machines. Some implementations of such gaming machines discussed herein may feature additional features, such as the ability to rotate, flip, or otherwise transform reel stops to enable award enhancements or other rewards and/or complete winning patterns along paylines of the gaming machines.

20 Claims, 22 Drawing Sheets

(56) References Cited

U.S. PATENT DOCUMENTS

| | | | | |
|---|---|---|---|---|
| D721,725 | S | 1/2015 | Pai | |
| D722,323 | S | 2/2015 | Pai | |
| D732,569 | S | 6/2015 | Anzures | |
| D737,833 | S | 9/2015 | Anzures et al. | |
| D748,136 | S | 1/2016 | Lee | |
| D752,632 | S | 3/2016 | Seo | |
| D759,085 | S | 6/2016 | Anzures | |
| D759,672 | S | 6/2016 | Birks et al. | |
| D762,658 | S | 8/2016 | Woo et al. | |
| D763,272 | S | 8/2016 | Tobens, III | |
| D771,074 | S | 11/2016 | Choi et al. | |
| 9,524,615 | B2 * | 12/2016 | Daeges | G07F 17/3262 |
| D792,452 | S | 7/2017 | Edman | |
| D792,896 | S | 7/2017 | Yamazaki | |
| D806,121 | S | 12/2017 | Jewitt | |
| D828,853 | S | 9/2018 | Schäper | |
| D836,661 | S | 12/2018 | Sakata | |
| D841,677 | S | 2/2019 | McMillan | |
| D851,657 | S | 6/2019 | Franklin | |
| D853,411 | S | 7/2019 | Broughton | |
| D872,113 | S | 1/2020 | Hsieh | |
| D877,809 | S | 3/2020 | Zellefrow | |
| 10,607,449 | B2 * | 3/2020 | Basallo | G07F 17/3239 |
| D888,762 | S | 6/2020 | Butcher | |
| 2002/0065124 | A1 | 5/2002 | Ainsworth | |
| 2003/0144048 | A1 | 7/2003 | Silva | |
| 2004/0087354 | A1 | 5/2004 | Ellis | |
| 2008/0209342 | A1 | 8/2008 | Taylor et al. | |
| 2008/0300037 | A1 * | 12/2008 | Wilson | G07F 17/34 463/16 |
| 2015/0346975 | A1 | 12/2015 | Lee | |
| 2016/0234453 | A1 | 8/2016 | Han | |
| 2020/0005588 | A1 | 1/2020 | Little | |

OTHER PUBLICATIONS

Office Action dated Mar. 20, 2020, for U.S. Appl. No. 29/663,455 (pp. 1-8).

Office Action dated Jul. 24, 2020 for U.S. Appl. No. 29/663,455 (pp. 1-9).

"Arrow, cartoon, right, toon, ui icon" Dec. 5, 2016, posted at iconfinder.com, [site visited Jul. 20, 2020], https://www.iconfinder.com/icons/1682717/arrow_cartoon_right_toon_uiJcon (Year: 2016).

"Arrow" Feb. 14, 2019, posted at iconfinder.com, [site visited Jul. 20, 2020], https://www.iconfinder.com/iconsets/arrow-65 (Year : 2018).

Notice of Allowance dated Oct. 1, 2020 for U.S. Appl. No. 29/663,455 (pp. 1-9).

* cited by examiner

ELECTRONIC GAMING MACHINE WITH NON-ORTHOGONALLY ARRANGED REEL POSITIONS

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) generally extending from the left side of the matrix through the matrix to the right side of the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player (RTP=return to player) over the course of many plays or instances of the game. The RTP and randomness of the RNG are critical to ensuring the fairness of the games and are therefore highly regulated. Upon initiation of play, the RNG randomly determines a game outcome and symbols are then selected which correspond to that outcome. Notably, some games may include an element of skill on the part of the player and are therefore not entirely random.

SUMMARY

Provided herein are various concepts relating to slot-machine type gaming machines that feature non-orthogonally arranged patterns of reels. Such reel arrangements may exhibit highest-order N-fold radial symmetry where N=3 or N≥5, and may feature groups of radially arrayed paylines. Due to the radial symmetry exhibited by such reel layouts or arrangements, a large number of paylines may be provided—far more than may feasibly be implemented on traditional, quadrilateral-format slot machines.

Some implementations of such gaming machines discussed herein may feature additional features, such as the ability to rotate, flip, or otherwise transform reel stops to enable award enhancements or other rewards and/or complete winning patterns along paylines of the gaming machines.

Various implementations of such gaming machines may include the implementations discussed below, although further implementations may be discussed later in this disclosure as well.

In some implementations, a system is provided that may include one or more displays and a game controller that includes one or more processors and one or more memory devices. In such systems, the one or more processors, the one or more memory devices, and the one or more displays may be operably connected, and the one or more memory devices may store computer-executable instructions for controlling the one or more processors to: cause a plurality of reel windows to be displayed on the one or more displays, each reel window configured to display a reel stop from a corresponding reel having a plurality of reel stops, receive a first signal indicating that a wager has been placed, select, based on one or more random outcomes and responsive to receipt of the first signal, a reel stop from each reel to display in the corresponding reel window independent of the outcomes of the reels corresponding to the other reel windows, cause the selected reel stop from each reel to be displayed in the corresponding reel window, determine whether the reel stops displayed in the reel windows correlate with one or more winning event patterns, and award a prize for each winning event pattern that is determined to be displayed by the reel stops. In such implementations, a first set of reel windows of the plurality of reel windows may be arranged in a first pattern having non-orthogonal radial symmetry about a center axis, and there may be at least two reel windows in the first set of reel windows arranged along a first axis and two reel windows in the first set of reel windows arranged along a second axis that is not orthogonal to the first axis.

In some such implementations of the system, the one or more memory devices may further store computer-executable instructions for further controlling the one or more processors to determine whether the reel stops displayed in the reel windows correlate with the one or more winning event patterns by, at least in part, evaluating patterns of reel stops that are displayed in reel windows that lie along one or more paylines, wherein each payline passes through a different plurality of reel windows and each payline includes a chain of adjacent reel windows.

In some further such systems, a second set of reel windows of the plurality of reel windows may be arranged in a second pattern having non-orthogonal radial symmetry, the second pattern may have an edge that is adjacent to an edge of the first pattern, and a subset of the one or more paylines may include paylines that pass through a chain of adjacent reel windows including at least one reel window in the first set of reel windows and at least one reel window in the second set of reel windows.

In some implementations of the system, the one or more memory devices may further store additional computer-executable instructions for further controlling the one or more processors to: cause one or more indicators to be displayed along one or more edges of the first pattern such that each indicator is adjacent to a corresponding location of one of the reel windows in a first subset of reel windows, and cause, responsive to receipt of a second signal, the reel stops displayed in one or more non-central reel windows to move to a position in the first pattern occupied by another reel stop, wherein each reel stop that is displaced by a moved reel stop itself moves to a position in the first pattern occupied by another reel stop.

In some implementations of the system, the one or more memory devices may further store additional computer-executable instructions for further controlling the one or more processors to cause the reel stops displayed in all of the non-central reel windows of the first set of reel windows to rotate about the center axis by the same amount.

In some implementations of the system, the one or more memory devices may further store additional computer-executable instructions for further controlling the one or more processors to cause reel stops displayed in a plurality of the non-central reel windows of the first set of reel windows to rotate about the center axis by the same amount so that each reel stop displayed in the plurality of non-central reel windows moves to a position occupied by the reel stop displayed in another one of the reel windows of the plurality of non-central reel windows prior to the rotation.

In some implementations of the system, the one or more memory devices may further store additional computer-executable instructions for further controlling the one or more processors to select a bilateral symmetry axis of the first pattern and cause the reel stops displayed in the reel windows of the first set of reel windows that do not intersect the bilateral symmetry axis to each swap places with the reel stop located the same distance from the bilateral symmetry axis on the opposite side of the bilateral symmetry axis and along an axis that is perpendicular to the bilateral symmetry axis and passes through each swapped pair of reel stops.

In some implementations of the system, each indicator may indicate an enhancement of a prize awarded for a winning event pattern that includes the reel stop adjacent to that indicator.

In some implementations of the system, each indicator may be one of the reel windows and at least some of the winning event patterns may include the reel stops corresponding with the reel windows that are indicators.

In some implementations of the system, the second signal may be indicative of a player input to the system.

In some implementations of the system, a first subset of the one or more paylines may include re-entrant paylines, and each re-entrant payline may start with a reel window located along an outer side of the first pattern, end with a reel window also located along the outer side, and include one or more reel windows that are not located along the outer side.

In some implementations of the system, a first subset of the one or more paylines may include non-entrant paylines, and each non-entrant payline may not include any reel windows that are located along outer edges of the first pattern.

In some implementations of the system, the one or more memory devices may further store additional computer-executable instructions for further controlling the one or more processors to: determine whether the reel stops displayed in the reel windows correlate with the one or more winning event patterns by, at least in part, evaluating patterns of reel stops that are displayed in reel windows located in locations non-adjacent to one another.

In some implementations of the system, the first pattern may have N-fold radial symmetry, wherein N is a value selected from the group consisting of: 3, 5, 6, and 7.

In some implementations of the system, each payline may include N or less reel windows, whereas in some other implementations, each payline may include N reel windows.

In some implementations of the system, each payline may pass through the same number of reel windows.

In some implementations, a method may be provided that includes: causing a plurality of reel windows to be displayed on one or more displays of a gaming machine, each reel window configured to display a reel stop from a corresponding reel having a plurality of reel stops, receiving a first signal indicating that a wager has been placed, selecting, based on one or more random outcomes and responsive to receipt of the first signal, a reel stop from each reel to display in the corresponding reel window independent of the outcomes of the reels corresponding to the other reel windows, causing the selected reel stop from each reel to be displayed in the corresponding reel window, determining whether the reel stops displayed in the reel windows correlate with one or more winning event patterns, and awarding a prize for each winning event pattern that is determined to be displayed by the reel stops. In such a method, a first set of reel windows of the plurality of reel windows may be arranged in a first pattern having non-orthogonal radial symmetry about a center axis, and there may be at least two reel windows in the first set of reel windows that are arranged along a first axis and two reel windows in the first set of reel windows that are arranged along a second axis that is not orthogonal to the first axis.

In some implementations, a non-transitory, computer-readable medium may be provided. The non-transitory, computer-readable medium may store machine-readable and executable instructions for controlling one or more processors to cause the one or more processors to: cause a plurality of reel windows to be displayed on one or more displays of a gaming machine, each reel window configured to display a reel stop from a corresponding reel having a plurality of reel stops, receive a first signal indicating that a wager has been placed, select, based on one or more random outcomes and responsive to receipt of the first signal, a reel stop from each reel to display in the corresponding reel window independent of the outcomes of the reels corresponding to the other reel windows, cause the selected reel stop from each reel to be displayed in the corresponding reel window, determine whether the reel stops displayed in the reel windows correlate with one or more winning event patterns, and award a prize for each winning event pattern that is determined to be displayed by the reel stops. In such implementations, a first set of reel windows of the plurality of reel windows may be arranged in a first pattern having non-orthogonal radial symmetry about a center axis, and there may be at least two reel windows in the first set of reel windows that are arranged along a first axis and two reel windows in the first set of reel windows that are arranged along a second axis that is not orthogonal to the first axis.

In some such implementations, the first pattern may have N-fold radial symmetry and N may be a value selected from the group consisting of: 3, 5, 6, and 7.

While the concepts discussed herein have been described with respect to the FIGS., it will be appreciated that many modifications and changes may be made by those skilled in the art without departing from the spirit of the invention.

DETAILED DESCRIPTION

Figure 1:
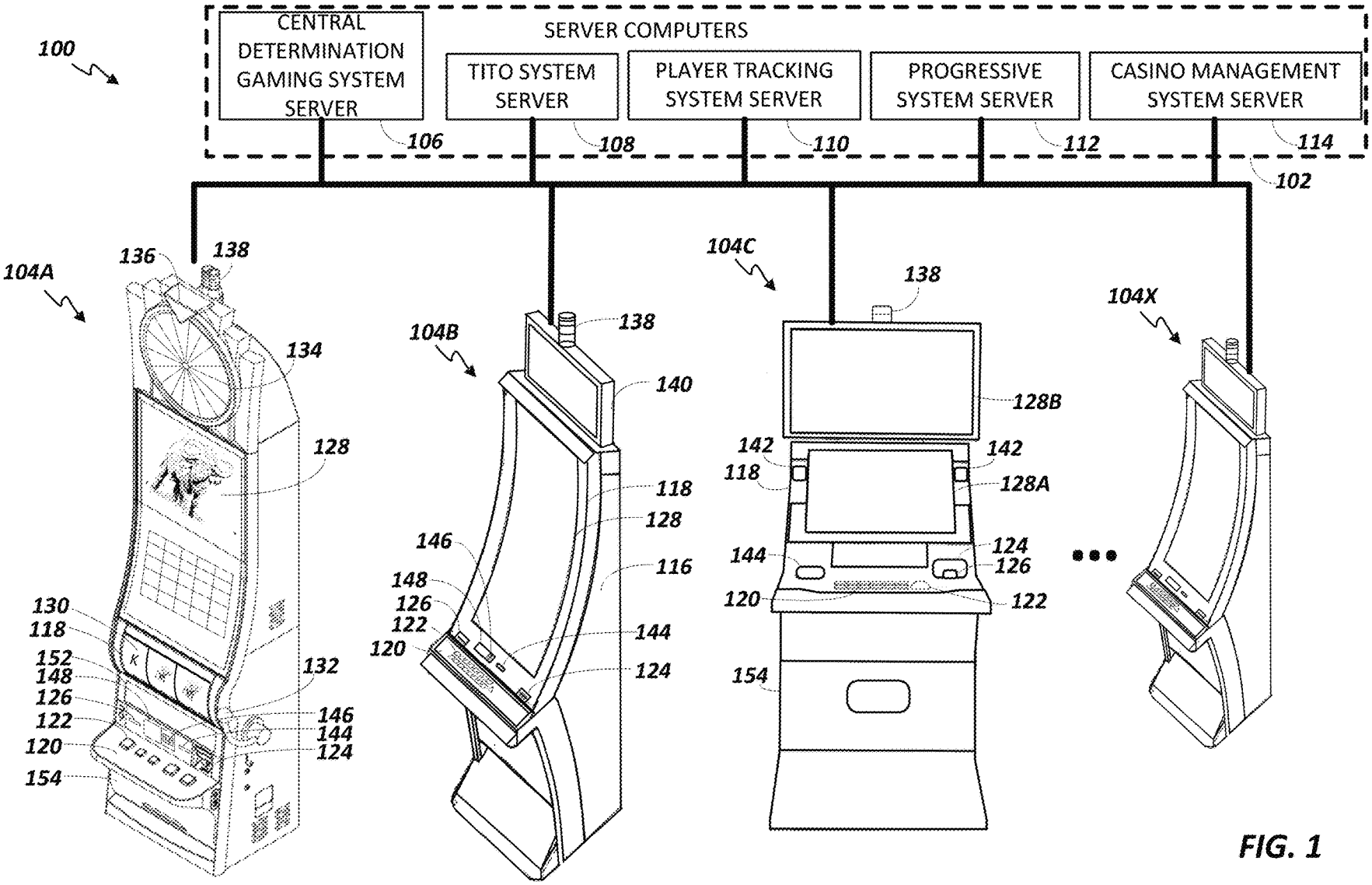
FIG. 1 is an exemplary diagram showing several EGMs networked with various gaming related servers.

FIG. 1 illustrates several different models of EGMs which may be networked to various gaming related servers. The present invention can be configured to work as a system 100 in a gaming environment including one or more server computers 102 (e.g., slot servers of a casino) that are in communication, via a communications network, with one or more gaming devices 104A-104X (EGMs, slots, video poker, bingo machines, etc.). The gaming devices 104A-104X may alternatively be portable and/or remote gaming devices such as, but not limited to, a smart phone, a tablet, a laptop, or a game console, although such devices may require specialized software and/or hardware to comply with regulatory requirements regarding devices used for wagering or games of chance in which monetary awards are provided.

Communication between the gaming devices 104A-104X and the server computers 102, and among the gaming devices 104A-104X, may be direct or indirect, such as over the Internet through a website maintained by a computer on a remote server or over an online data network including commercial online service providers, Internet service providers, private networks, and the like. In other embodiments, the gaming devices 104A-104X may communicate with one another and/or the server computers 102 over RF, cable TV, satellite links and the like.

In some embodiments, server computers 102 may not be necessary and/or preferred. For example, the present invention may, in one or more embodiments, be practiced on a stand-alone gaming device such as gaming device 104A, gaming device 104B or any of the other gaming devices 104C-104X. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door 154 which provides access to the interior of the cabinet. Gaming device 104A typically includes a button area or button deck 120 accessible by a player that is configured with input switches or buttons 122, an access channel for a bill validator 124, and/or an access channel for a ticket printer 126.

In FIG. 1, gaming device 104A is shown as a Relm XL™ model gaming device manufactured by Aristocrat® Technologies, Inc. As shown, gaming device 104A is a reel machine having a gaming display area provided by a main display 128 that may display a number (typically 3 or 5) of mechanical reels 130 with various symbols displayed on them. The reels 130 are independently spun and stopped to show a set of symbols within the gaming display area which may be used to determine an outcome to the game.

In many configurations, the gaming machine 104A may have a main display 128 (e.g., video display monitor) mounted to, or above, the gaming display area. The main display 128 can be a high-resolution LCD, plasma, LED, or OLED panel which may be flat or curved as shown, a cathode ray tube, or other conventional electronically controlled video monitor.

In some embodiments, the bill validator 124 may also function as a "ticket-in" reader that allows the player to use a casino issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are well known in the art and are used to generate and track unique bar-codes or other indicators printed on tickets to allow players to avoid the use of bills and coins by loading credits using a ticket reader and cashing out credits using a ticket-out printer 126 on the gaming device 104A.

In some embodiments, a player tracking card reader 144, a transceiver for wireless communication with a player's smartphone, a keypad 146, and/or an illuminated display 148 for reading, receiving, entering, and/or displaying player tracking information is provided in EGM 104A. In such embodiments, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2:
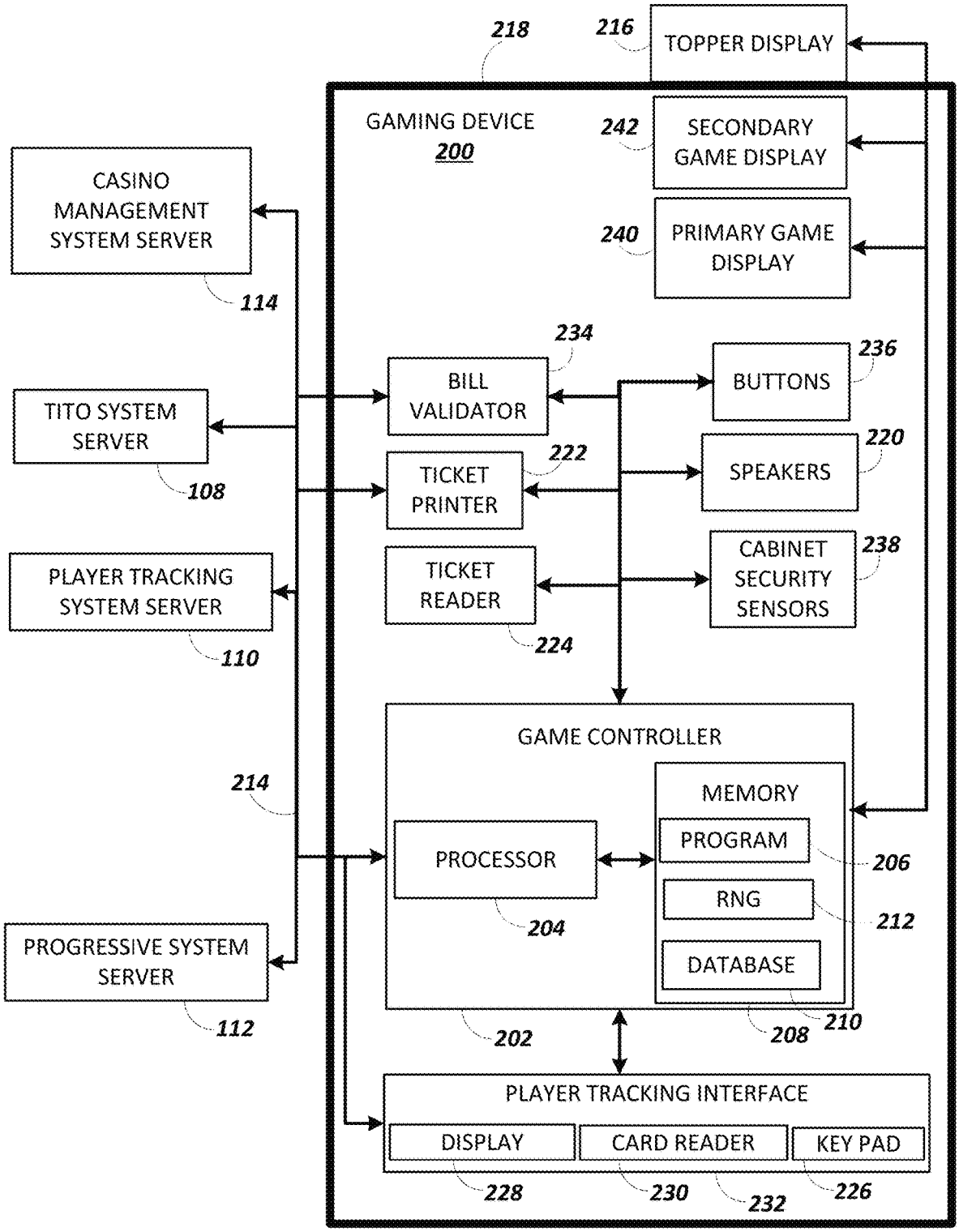
FIG. 2 is a block diagram showing various functional elements of an exemplary EGM.

Many or all the above described components can be controlled by circuitry (e.g., a gaming controller) housed inside the main cabinet 116 of the gaming device 104A, the details of which are shown in FIG. 2.

Note that not all gaming devices suitable for implementing embodiments of the present invention necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door 118 which opens to provide access to the interior of the gaming device 104B. The main or service door 118 is typically used by service personnel to refill the ticket-out printer 126 and collect bills and tickets inserted into the bill validator 124. The door 118 may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, display 128A is a flat panel display. Main display 128A is typically used for primary game play while secondary display 128B is typically used for bonus game play, to show game features or attraction activities while the game is not in play or any other information or media desired by the game designer or operator.

Many different types of games, including mechanical slot games, video slot games, video poker, video blackjack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2 is a block diagram depicting exemplary internal electronic components of a gaming device 200 connected to various external systems. All or parts of the example gaming device 200 shown could be used to implement any one of the example gaming devices 104A-X depicted in FIG. 1. The games available for play on the gaming device 200 are controlled by a game controller 202 that includes one or more processors 204 and a game that may be stored as game software or a program 206 in a memory 208 coupled to the processor 204. The memory 208 may include one or more mass storage devices or media that are housed within gaming device 200. Within the mass storage devices and/or memory 208, one or more databases 210 may be provided for use by the program 206. A random number generator (RNG) 212 that can be implemented in hardware and/or software is typically used to generate random numbers that are used in the operation of game play to ensure that game play outcomes are random and meet regulations for a game of chance.

Alternatively, a game instance (i.e. a play or round of the game) may be generated on a remote gaming device such as a central determination gaming system server 106 (not shown in FIG. 2 but see FIG. 1). The game instance is communicated to gaming device 200 via the network 214 and then displayed on gaming device 200. Gaming device 200 may execute game software, such as but not limited to video streaming software that allows the game to be displayed on gaming device 200. When a game is stored on gaming device 200, it may be loaded from a memory 208 (e.g., from a read only memory (ROM)) or from the central determination gaming system server 106 to memory 208. The memory 208 may include RAM, ROM or another form of storage media that stores instructions for execution by the processor 204.

The gaming device 200 may include a topper display 216 or another form of a top box (e.g., a topper wheel, a topper screen, etc.) which sits above main cabinet 218. The gaming cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. The player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. Ticket printer 222 may be used to print tickets for a TITO system server 108. The gaming device 200 may further include a bill validator 234, buttons 236 for player input, cabinet security sensors 238 to detect unauthorized opening of the cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

Gaming devices, such as gaming devices 104A-104X, 200, are highly regulated to ensure fairness and, in many cases, gaming devices 104A-104X, 200 are operable to award monetary awards (e.g., typically dispensed in the form of a redeemable voucher). Therefore, to satisfy security and regulatory requirements in a gaming environment, hardware and software architectures are implemented in gaming devices 104A-104X, 200 that differ significantly from those of general-purpose computers. Adapting general purpose computers to function as gaming devices 200 is not simple or straightforward because of: 1) the regulatory requirements for gaming devices 200, 2) the harsh environment in which gaming devices 200 operate, 3) security requirements, 4) fault tolerance requirements, and 5) the requirement for additional special purpose componentry enabling functionality of an EGM. These differences require substantial engineering effort with respect to game design implementation, hardware components and software.

When a player wishes to play the gaming device 200, he/she can insert cash or a ticket voucher through a coin acceptor (not shown) or bill validator 234 to establish a credit balance on the gamine machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views the game outcome on the game displays 240, 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

The present inventor conceived of new slot machine formats in which the reels of the slot machine are arranged in a non-orthogonal manner. In a conventional slot machine, a plurality of reels are typically arranged along a common axis. A reel may be thought of as a "pool" of reel stops from which a particular reel stop may be randomly selected. In a traditional, physical reel, the reel stops corresponded to physical locations on the reels, each having a different number, symbol, graphic, or other marker. Due to their physical configuration, physical reels were often arranged side-by-side so that they shared an axis of rotation. This helped ensure that the reel stops on the reels would line up with each other, while also allowing the reels to be placed in close proximity to one another. This convention has largely carried forward into modern gaming machines, in which the physical reels have been replaced with virtual reels that are displayed on a display screen.

In a mechanical slot machine, a "reel stop" refers to a position on a physical reel that corresponds to a particular outcome for that reel; each reel stop has a particular symbol, number, graphic, or other marker associated with it, and the combinations of such symbols, numbers, or markers that are displayed across multiple reels are evaluated to determine if a winning pattern is shown. In an electronic/video slot machine, a reel stop refers to the symbols, numbers, graphics, or other markers that are included in a virtual reel.

In modern gaming machines, reels may be virtually implemented in a manner similar to a physical reel, e.g., with the reel stops stored in a format that preserves the relative ordering or positioning of each reel stop with respect to the "adjacent" reel stops. Thus, if a reel stop with particular symbol is only included once in a given reel, each time that reel stop is shown, the reel stops adjacent to it, if shown, will not vary in terms of what symbols they display. In the context of this application, reels are to be understood as not only encompassing "traditional" virtual reels in which the relative ordering or positioning of reel stops in the reel is stored, but also "non-traditional" virtual reels in which the relative order of the reel stops is not defined. In such non-traditional virtual reels, each reel stop may simply be associated with a probability of occurrence, e.g., a range of outcomes of a random number generator, governing the frequency with which that reel stop is selected as the outcome for that reel. Traditional virtual reels may typically be used to maintain the feeling that the player is playing a "traditional" slot machine in which the order of reel stops on a reel is static, which can increase player excitement. For example, when multiple reel stops of a reel are visible simultaneously, the player may, over time, recognize that certain patterns of reel stop symbols on a reel may immediately precede the appearance of a particular high-value reel stop symbol on that reel—when the player recognizes such patterns, which usually occurs as the reel slows down and prepares to stop, the player's excitement may be increased since they may know that the high-value reel symbol has a high chance of appearing based on the patterns of the reel stops and may thus increase their chances of winning and/or the prize amount.

As noted above, the convention of arranging reels in a single linear or rectangular array has persisted—this is the case even with slot machines that do not display the reels in a standard rectangular format. For example, U.S. Pat. No. 5,413,342 describes a slot machine with three mechanical "reels" that are each arranged to rotate about a vertical axis. The reels, in this case, are actually belts that have the reel stops arranged along the length of the belt. This particular slot machine is designed so that a smaller number of reel stops is visible for each reel compared to the number of reel stops visible for the reel immediately below it, giving the appearance of a triangle. However, the reels themselves, in this instance, are laid out in a manner similar to a traditional slot machine, e.g., side-by-side along a single axis, i.e., in a linear array.

In contrast, the slot machines conceived of herein feature reels arranged along multiple, non-orthogonal axes. Such arrangements may be laid out so as to form a radially symmetric layout of reels. This allows for considerable flexibility in arranging the reels, allowing for a larger number of reels to be presented to the player than in conventionally arranged slot machines. This provides a much larger set of potential outcomes that may be presented to the player, along with a host of new types of paylines that may be implemented to allow for new and exciting opportunities for players to experience a winning event. Such slot machines may also allow for exciting new features to be implemented, such as the ability to rotate all or part of the reel outcomes about a center point or center axis of the reel field so as to provide for new patterns and winning outcomes.

To be clear, reels that are orthogonally arranged may be arranged in a single, linear array, e.g., along a single axis, or may be arranged as a single rectangular array, e.g., along two axes that are perpendicular to each other, with the same number of reels located in each column of reels. Non-orthogonally arranged reels may feature reels arranged along multiple axes that are not all perpendicular to each other or arranged so as to not form a single linear or rectangular array.

In implementations having non-orthogonally arranged reels, as discussed herein, each reel may be associated with a corresponding reel window. Reel windows, in a mechanical slot machine, refer to the actual physical windows through which portions of the reels may be seen; the patterns of reel stops visible through the reel windows may be determinative of whether or not the player has achieved a winning combination of reel stops. In an electronic/video slot context, reel windows refer to portions of a display screen that are used to display reel stops for a virtual reel. Some reel windows may be sized so as to show multiple reel stops from a reel simultaneously, e.g., 3 or 5 reel stops, or may be sized so as to be able to show only one complete reel stop. In some slot machines with reel windows for reels arranged in non-orthogonal, radially symmetric patterns, only one reel stop at a time for each reel may be visible within the corresponding reel window, in which case the ability of players to be able to recognize reel stop patterns for the reels may be much more limited. Accordingly, such implementations may use "non-traditional" virtual reel systems in which the relative order and/or positioning of the reel stops is not maintained. Other implementations of slot machines with reel windows arranged in non-orthogonal, radially symmetric patterns, however, may use "traditional" virtual reels.

As discussed above, slot machines with non-orthogonally arranged reels may allow for a wider variety of paylines to be used. In a traditional slot machine, the payline was actually a physical line that a winning combination of reel stops had to line up with in order to be recognized as a winning pattern. Modern slot machines allow for multiple different paylines to be evaluated for a single set of reel outcomes, thereby providing the player with increased chances of winning for a given reel outcome. Modern slot machine paylines typically extend from the left side of the reel set to the right side of the reel set and pass through one potential reel stop location of each reel/reel window before continuing on to the next reel/reel window. Such paylines may, for example, be horizontal straight lines or may include occasional shifts to other elevations as they extend transversely across the reels. In modern slot machines, the paylines may be hidden from view (but caused to become visible, e.g., in response to a user-initiated input requesting that the paylines be displayed or when a winning pattern of reel stops occurs on a particular payline, in which case the gaming machine may cause the winning payline—or all of the paylines—to be displayed. Paylines, when displayed, may be displayed as lines, as graphical objects that are animated to follow paths defined by the paylines, or as graphical linking elements that may span between portions of adjacent reels to show which potential reel stop positions may be linked to other potential reel stop positions to form a winning pattern for that payline.

As mentioned previously, slot machines having non-orthogonally arranged reels may exhibit radial symmetry. Objects arranged in a radially symmetric manner may have varying degrees of radial symmetry. In a radial array, multiple instances of an object (which may be a single object or a pattern of objects) may, in effect, be rotated about a common center point and spaced apart from one another such that corresponding locations of each instance are located at evenly spaced-apart locations on a circle centered on the common center point. Thus, if there are four instances that are radially arrayed about a common center point, this would be an example of 4-fold radial symmetry. Similarly, if there are eight instances that radially arrayed about a common center point, this would be an example of 8-fold radial symmetry. Some instances of radial arrays may include multiple orders of N-fold symmetry. For example, a square array of four objects has both bi-fold radial symmetry (N=2, with each of two radially arrayed instances including the same pattern of two objects) and 4-fold (N=4) radial symmetry (with each radially arrayed instance including only one object). Similarly, an octagonal array of sixteen objects may have bi-fold radial symmetry (in which each radially arrayed instance includes 8 identically arranged objects), 4-fold radial symmetry (in which each radially arrayed instance includes 4 identically arranged objects), and 8-fold radial symmetry (in which each radially arrayed instance includes 2 identically arranged objects). The "highest-order N-fold symmetry" of a radially symmetric pattern refers to the highest possible value of "N" that can be used to describe the N-fold symmetry evident in that radially symmetric pattern. Thus, in the example of an octagonal radial array of asymmetric objects, the highest-order N-fold symmetry would be 8-fold radial symmetry (while such a pattern would also inherently have bi-fold or 4-fold symmetry, these would be lower-order radial symmetries and thus not the highest-order). As will become evident from the discussion herein, slot machines with non-orthogonally arranged reels exhibiting highest-order N-fold symmetries for values of N=3 and N≥5 may present particularly unique layouts of reels and allow for unique payline geometries. Slot machines with highest-order N-fold symmetries with N=4 still exhibit a generally orthogonal layout of reels and are thus not considered to be of interest with respect to this disclosure.

Figure 3:
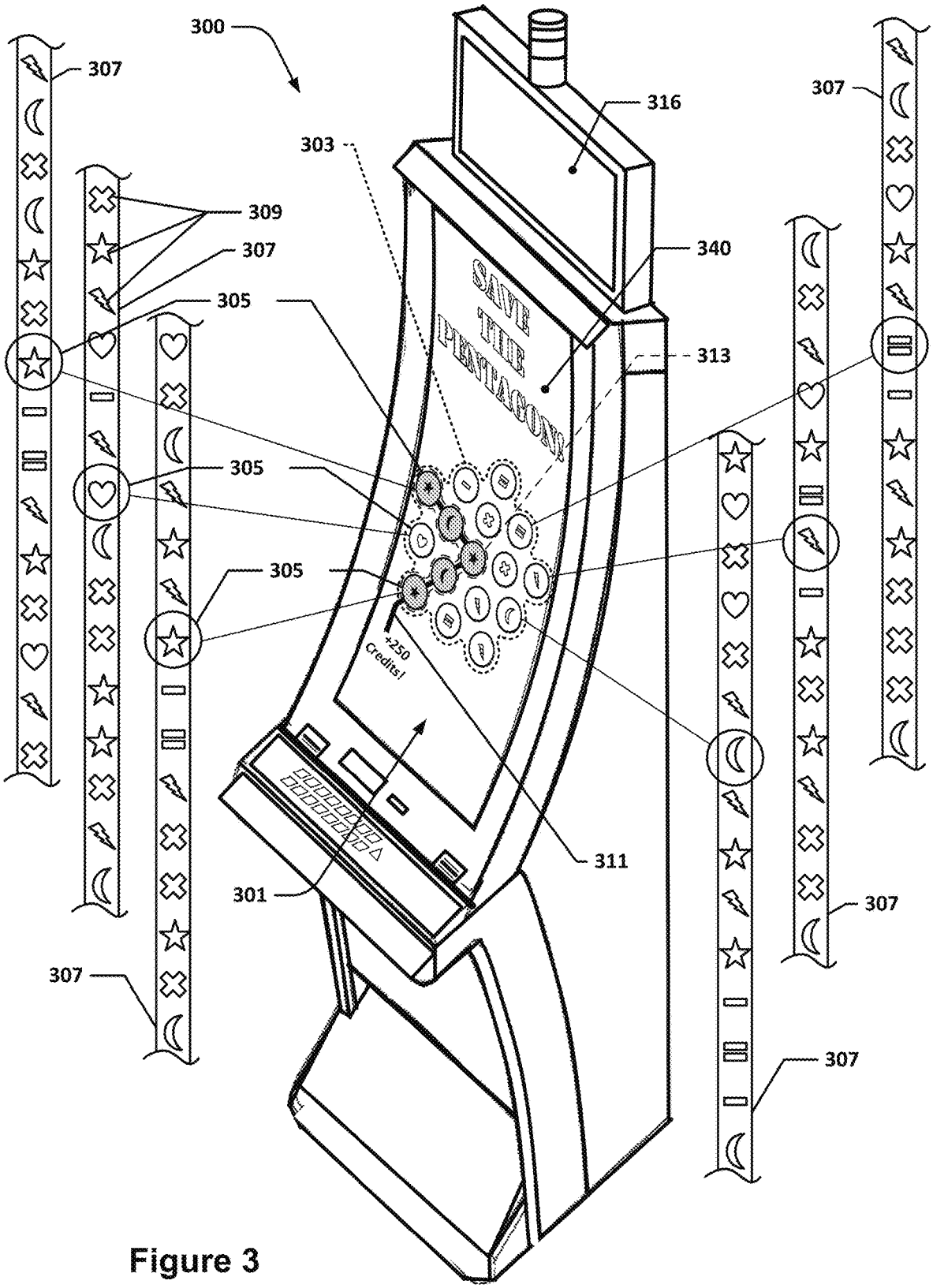
FIG. 3 depicts an example gaming device or gaming machine that is configured to allow for play of a game of chance featuring non-orthogonally arranged reels in accordance with the concepts discussed herein.

FIG. 3 depicts an example gaming device or gaming machine that is configured to allow for play of a game of chance featuring non-orthogonally arranged reels in accordance with the concepts discussed herein. Gaming machine 300 may have similar hardware as gaming machine/device 200 and/or gaming machines/devices 104A-X, including, for example, a primary game display 340 and, in some implementations, a topper display 316, either or both of which may be used, in various implementations, to display a game of chance 301 that includes a plurality of reels 307 that are arranged in a non-orthogonal arrangement 303—in this case, the arrangement is pentagonal in nature, and has a highest-order N-fold radial symmetry with N=5. Each reel 307 may include a plurality of reel stops 309, one or more of which may be visible through reel windows 305, each of which may be associated with a different reel 307. The reel windows 305 may, in some respects, be viewed as placeholders for each reel 307. For example, while reels 307 are graphically depicted as they might appear if the reel strip of a physical reel were to be removed from the reel and rolled out flat, reels 307 are instead virtual reels, in which case they may, as discussed earlier, be "traditional" virtual reels (as shown or suggested in FIG. 3) or "non-traditional" virtual reels, e.g., reels in which the relative order of symbols in the reel may not necessarily be maintained and in which the reel stop shown for each instance of play is randomly selected according to the predefined probabilities of occurrence for each reel stop. It will be understood that the reel windows 305, in this case, may serve as positional locators for their corresponding reels 307, and that a reel 307 may be considered to be arranged in a particular location when the reel window 305 showing its present outcome (or outcomes) is located at that location. For the sake of clarity, a reel 307 may be considered to be located or arranged in a particular location when the current outcome of that reel 307 is able to be seen through a corresponding reel window 305 at that location by a player.

The gaming machine 300 may include a game controller with one or more processors and one or more memory devices that store computer-executable instructions for controlling the one or more processors to perform various actions or cause various other equipment, like the primary game display 340, to perform various actions. In some implementations, the game controller may exist partially or entirely in a remote location, such as part of a gaming server that provides gaming functionality to multiple gaming machines (in such cases, the gaming machine may have very limited processing capability, and may act as a "dumb" terminal or extension of the gaming server).

Figure 4:
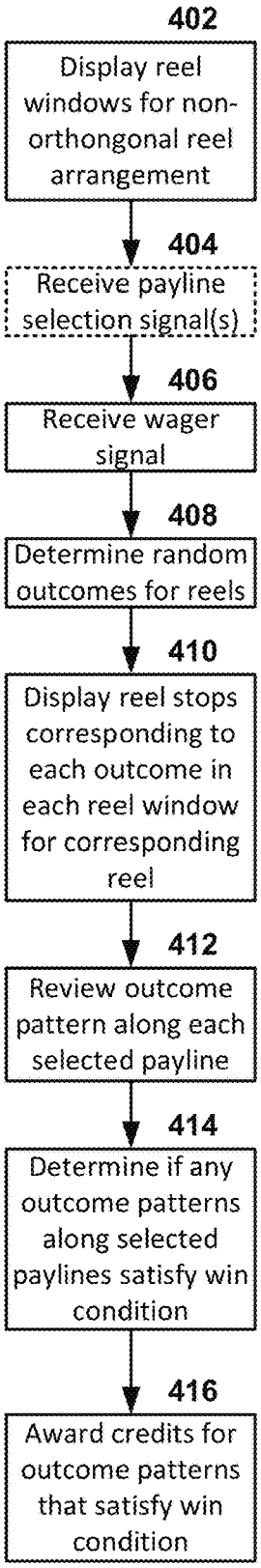
FIG. 4 is a block diagram of a high-level technique for operating a gaming machine or system in accordance with the principles and concepts discussed herein.

FIG. 4 is a block diagram of a high-level technique for operating a gaming machine or system in accordance with the principles and concepts discussed herein. Such instructions, for example, may be configured to cause the one or more processors to implement such a technique and, in block 402, cause a non-orthogonally arranged layout of reels to be displayed on one or more displays of the gaming machine, e.g., the primary game display 340. The instructions may also cause the one or more processors to receive one or more payline selection signals in block 404 (which may be optional; some implementations may have a fixed or unchangeable selection of paylines), a signal or input in block 406 indicating that a wager has been placed in a game of chance using the non-orthogonally arranged layout of reels, receive or generate one or more random outcomes that govern outcomes, e.g., reel stops, for each reel of the non-orthogonally arranged layout of reels responsive to such wager placement in block 408, and cause reel stops corresponding to those outcomes to be displayed in reel windows of those reels in block 410. The instructions may further cause the one or more processors to review the outcomes along each selected paylines (paylines and payline selection are discussed in more detail below) in block 412 to determine in block 414 if a winning pattern is displayed or formed by the displayed reel stops. The instructions may then cause the game of chance 301 to award prizes or awards in block 416 based on the occurrence of winning patterns 313, in this case a star-moon-star-moon-star pattern, that may occur along one or more paylines 311 after the reels 307 have each generated a respective outcome.

While only one payline 311 is shown in FIG. 3, the gaming machine 300 may reference multiple paylines 311 in determining whether winning patterns of reel stops 309 exist along any of the paylines 311. Such paylines may, in some implementations, be clustered together in groups of paylines that exhibit common characteristics, e.g., the same shape, but rotated through each of N positions, where N is the highest-order N-fold symmetry of the reel pattern. In such implementations, each group of paylines may share one or more common characteristics, e.g., a common winning effect, common winning patterns, common selectability, and so forth. For example, in some implementations, one or more groups of paylines may be selected by a player, although other implementations may allow for the selection of individual paylines by the player in place of or in addition to the selection of groups of paylines by the player. In some implementations allowing for groups of paylines to be selected, each payline group may have a number of paylines in it that is an even multiple of the highest radial symmetry order, e.g., for a reel layout with 5-fold highest order radial symmetry, each payline group may include 5, 10, 15, etc. paylines in it. In implementations allowing for payline selection, the player may be provided by the gaming machine 300 with the option of selecting one or more paylines or groups of paylines for one or more upcoming game plays. In the following discussions, it will be understood that examples that are discussed in the context of being applicable to payline groups may also be generally applicable to implementations allowing for single payline selection as well. In most implementations, selection of a payline group may require an increase in the amount to be wagered for each play. For example, a gaming machine 300 may allow a player to select as many payline groups as they want, but each selected payline group may require that the wager be increased by a corresponding predetermined amount of credits, e.g., 1 credit, 2 credits, 3 credits, or some other amount. In some implementations, a gaming machine 300 may allow the player to select a predetermined number of payline groups before requiring any wager increase beyond the minimum needed in order to place a wager. For example, a player may be provided with an opportunity to choose between X and Y payline groups, where X and Y are positive integers greater than or equal to 1 and Y is greater than X, for any given play of such a game of chance 301 before having to increase the amount wagered. This allows the player to select a base group or groups of paylines 311 that will be used to determine if a winning pattern or patterns 313 are indicated without increasing the wager amount. However, such gaming machines 300 may allow for more than Y payline groups to be selected by the player in exchange for an increase in wagering amount for each payline group beyond the Y payline groups that is selected.

In some implementations, certain paylines and/or payline groups may be "fixed" or pre-selected and may, in some instances, not be changeable by the player. For example, a base group of paylines may be enabled for every player regardless of what additional payline groups they may select. It is also to be understood that some payline groups may include only one payline, although such a payline may still exhibit radial symmetry similar to payline groups having multiple paylines.

The amounts wagered may be allocated or distributed between the various paylines and/or payline groups selected for play. Accordingly, the award or prize that is determined for a winning pattern along a particular payline may be determined, at least in part, according to the portion of the amount wagered allocated to that payline.

Paylines, such as the payline 311, may be displayed on demand, e.g., in response to a player pressing a "show paylines" button, during payline group selection (in which paylines in each group of paylines may be depicted), after a winning pattern has been achieved for a payline (in which case the relevant payline(s) may be displayed), and during play, e.g., selected paylines or paylines in selected payline groups may be displayed, e.g., using differently colored "jellybean" connectors (small, color links than look a little like jelly beans) linking the reel windows 305 for each payline together, or using some other type of indicator that does not obscure the reel stops.

To better illustrate the number and types of paylines that may be implemented with non-orthogonal reel layouts such as are discussed herein, various example non-orthogonal reel layouts are discussed in FIGS. 5 through 46.

FIGS. 5 through 26 depict an example pentagonal reel layout, similar to the one depicted in the example gaming machine 300 discussed above, with different payline groups (and paylines) depicted in each Figure.

Figure 5:
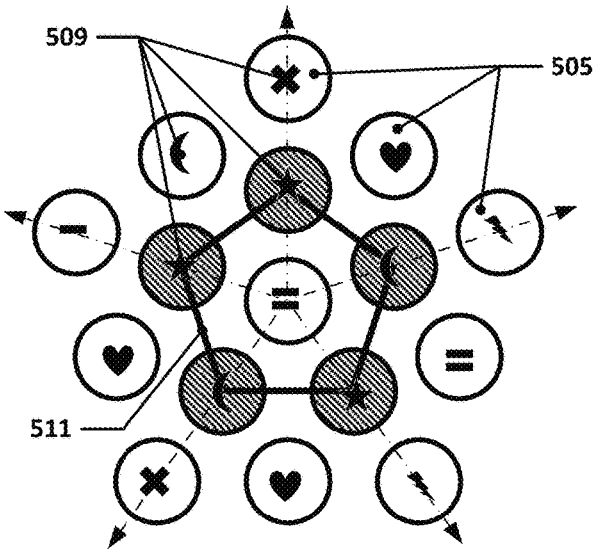
FIGS. 5 through 26 depict an example pentagonal reel layout, similar to the one depicted in the example gaming machine of FIG. 3, with different payline groups (and paylines) depicted in each FIG.

FIG. 5 depicts a pentagonal reel layout with reel stops 509 (depicting various symbols, such as lightning bolts, bars, X's, moons, stars, and hearts) from each reel shown in corresponding reel windows 505. The reel stops 509 are not depicted in the other FIGS. 6 through 26, although it will be understood that similar reel stops 509 would be visible in the reel windows 505 in those Figures. In FIG. 5, a single payline 511 is shown; this payline is a "non-entrant," "contained," or "closed" payline, i.e., it does not include reel windows 505 or reels that are located along the edges of the pentagonal reel arrangement. In this case, the non-entrant payline has the same overall shape of the reel arrangement, e.g., a pentagon, and includes the reel stops in the five reel windows 505 surrounding the center of the reel arrangement. In this example, a winning pattern including star and moon symbols lies along the indicated payline; the reel windows 505 containing those symbols have been shaded to distinguish them from the other reel windows 505; this convention is carried forward in FIGS. 6 through 26 as well. The dash-dot-dash lines extending outward from the center of the reel arrangement are provided to demonstrate the five-fold radial symmetry of this arrangement, but are omitted in FIGS. 6 through 26. In large-size pentagonal arrangements, additional closed or non-entrant paylines may be defined as well. In some implementations, non-entrant paylines may also include more or fewer reel windows from those shown. For example, instead of the indicated "hollow" pentagon payline, such a payline may also include the centermost reel window, making it a "solid" pentagon. For clarity, the centermost reel window of a reel arrangement may be referred to herein as the "center" reel window or the liker, whereas the other reel windows in such an arrangement may be referred to as "non-central" reel windows. Alternatively, the centermost reel window may be included and one of the other reel windows depicted as being included in FIG. 5 may be omitted. In the latter case, there may be, in this example, a group of five such "dented pentagon" paylines, each rotated 72° from the adjacent one.

Figure 6:
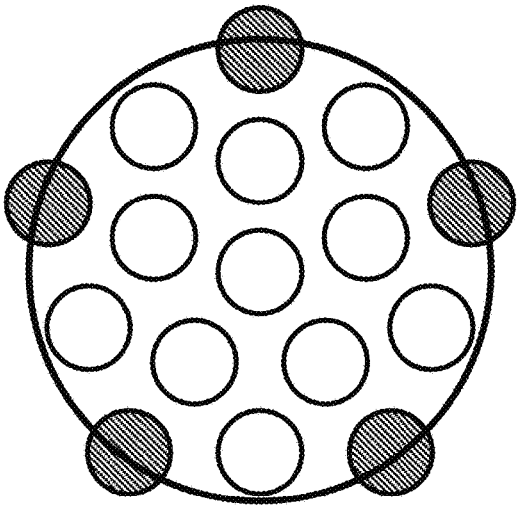

FIG. 6 depicts the pentagonal reel arrangement from FIG. 5, but with a "bingo," "unconnected," "noncontiguous," or "corner" payline depicted, e.g., a payline in which the reel windows in the pattern do not form a continuous line and may have one or more reel windows/reel stops or groups thereof that are disconnected from other reel windows/reel stops or groups thereof. In this example, the payline only includes the corner reels or reel windows, e.g., non-adjacent reel windows, of the reel arrangement, and the winning pattern may be determined based on the reel stops visible in only those locations.

The paylines depicter in FIGS. 5 and 6 have radial symmetry to them that matches that of the reel window arrangement. In the case of FIG. 5's payline 511, the payline is pentagonal, just like the reel arrangement. In the case of FIG. 6's payline, the payline is "circular" or otherwise includes reels or reel windows laid out in an arrangement that has 5-fold radial symmetry, just like the reel arrangement does. Other paylines, however, may not have such characteristics, in which case it may be desirable to provide multiple instances of such paylines as a set or group of paylines that are arrayed about the center point of the reel arrangement in a circular array.

Figure 7:
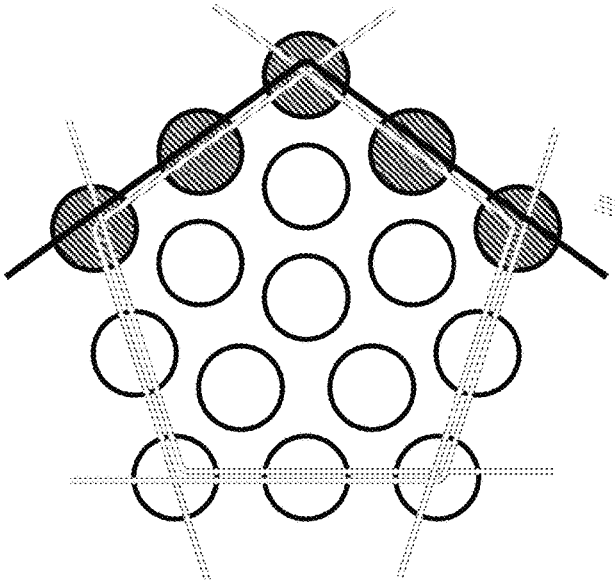

FIG. 7, for example, depicts the reel arrangement of FIG. 5, but with a payline group of five paylines shown, with each payline having a "outside chevron" shape to it and including the reels or reel windows along two adjacent outer edges of the reel arrangement. In this example and in later examples, one of the paylines is shown in solid black, and the reel windows it goes through are shaded, to better illustrate the appearance/path of the payline. The other paylines that are depicted are shown as thick, white lines with dark grey edges, and it will be recognized that each payline shown is, for each Figure, just another instance of the payline indicated by the solid black line that has been rotated about the center of the pentagonal arrangement by some integer multiple of 360°/N, where N is the highest order symmetry of the arrangement (N=5 in this case). The "outside chevron" label used above is used because the chevron shapes of the paylines lie along the outside of the pentagonal reel pattern. The payline group of all five such paylines may form an overall pentagonal shape, and may be referred to as a "pentagonal" payline group.

Figure 8:
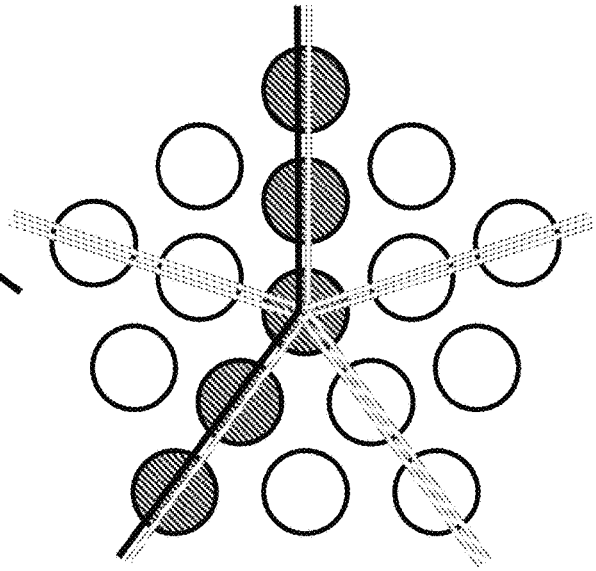

FIG. 8 depicts another payline group for a pentagonal reel arrangement, this time with "inside chevron" paylines, e.g., each chevron starts and ends with a reel or reel window that lies along the outside of the reel arrangement, but includes additional reels or reel windows that do not. The payline group of all five such paylines may be referred to as a "woven asterisk," "Celtic asterisk," or "crossover asterisk" payline group given that the grouped paylines generally have the appearance of an asterisk, but with each payline crossing over and/or being crossed over by the other paylines.

Figure 9:
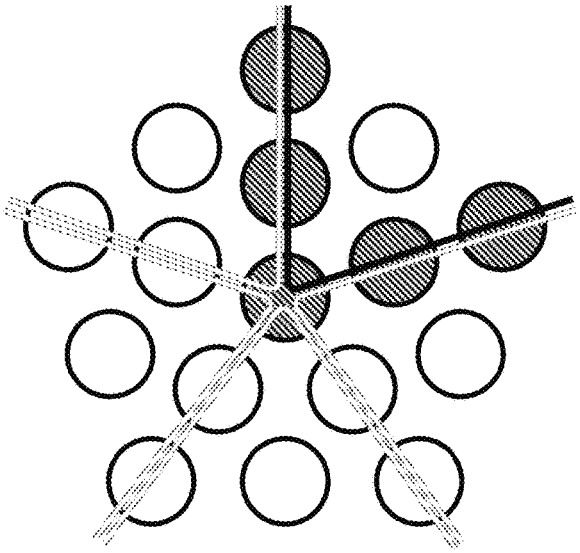

FIG. 9 depicts another payline group for a pentagonal reel arrangement, this time with "pentant" or "pie slice" paylines, e.g., each pentant starts and ends with adjacent corner reel or reel windows that lie along the outside of the reel arrangement and extend to the center reel or reel window, thus dividing the reel arrangement into five "pie slices" or "pentants" (a pentant is the result of dividing a geometric shape into five equally sized and shaped pieces, similar to how a quadrant results from dividing a shape into four similar sized and shaped pieces, and a sextant results from dividing a shape into six similar sized and shaped pieces. Paylines such as the depicted paylines may also be referred to as "re-entrant" or "same-side" paylines, as they may have endpoints that terminate at reels or reel windows located along a common side of the reel arrangement, as opposed to lying along two entirely different sides of the reel arrangement; paylines that start and end along two adjacent sides of the reel arrangement may be referred to herein as "adjacent-side" paylines. The payline group of all five such paylines may be referred to as a "asterisk" given that the grouped paylines generally have the appearance of an asterisk.

Figure 10:
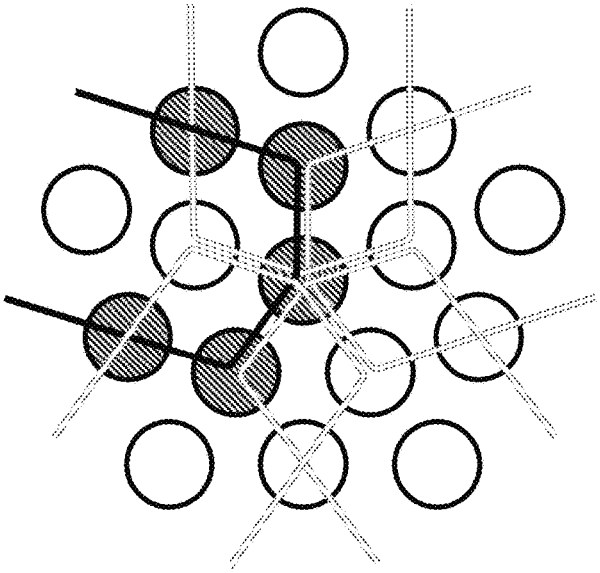

FIG. 10 depicts another payline group for a pentagonal reel arrangement, this time with "double-prong," "cocktail fork," or "U" paylines. Such paylines may have a have a generally U-shaped appearance, starting and ending with reels or reel windows located along the middle (or at least, the non-corner locations) of two adjacent sides of an arrangement of reels or reel windows (and would thus be considered "adjacent-side" paylines, as noted above). Payline groups consisting of such paylines may be referred to as "faceted star" or "diamond star" payline groups, as they appear to be star-shaped, but with each arm of the star formed by a discrete diamond subshape.

Figure 11:
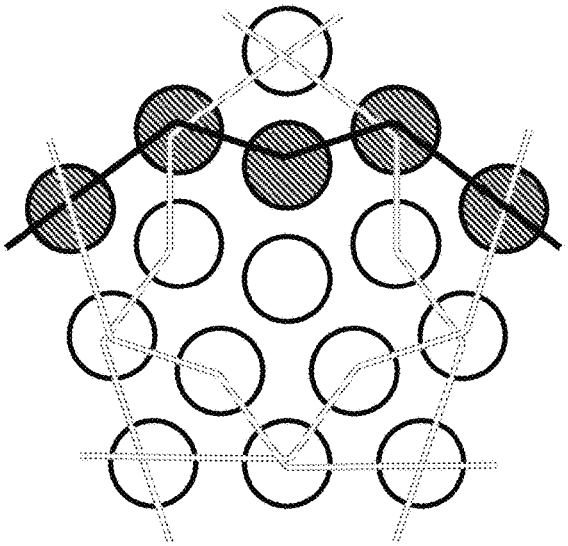

FIG. 11 depicts another payline group for a pentagonal reel arrangement, this time with "seagull" paylines, which appear similar to simplified representations of seagulls or other birds in flight. Seagull paylines may be similar to outer chevron paylines, but with the middle corner reel window or reel omitted, and the payline instead passing through the reel or reel window that is next to the omitted corner reel or reel window. Seagull paylines may, when grouped together, form a "star" payline group.

Figure 12:
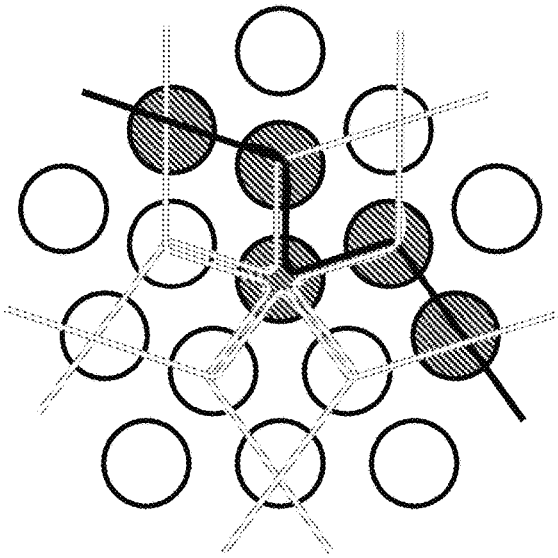
Figure 13:
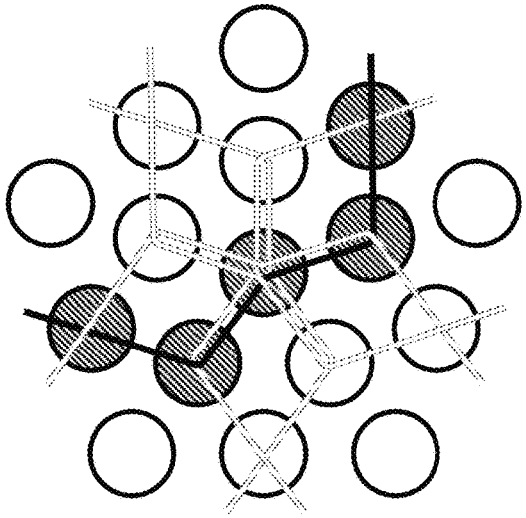

FIGS. 12 and 13 depict other payline groups of a pentagonal reel arrangement, this time with "sombrero" paylines (FIG. 12), which are similar to the seagull paylines discussed in FIG. 11, but with a more acute point in the middle, and "wide-W" paylines (FIG. 13). These paylines, when grouped together, may also form "diamond star" or "faceted star" payline groups.

Figure 14:
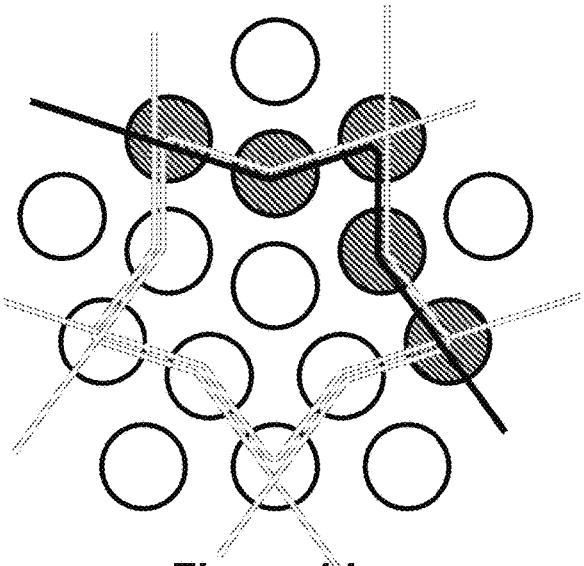

FIG. 14 depicts another payline group for a pentagonal reel or reel window arrangement, this time with "witch hat" paylines, which may be grouped together into a payline group with a "star" shape.

Figure 15:
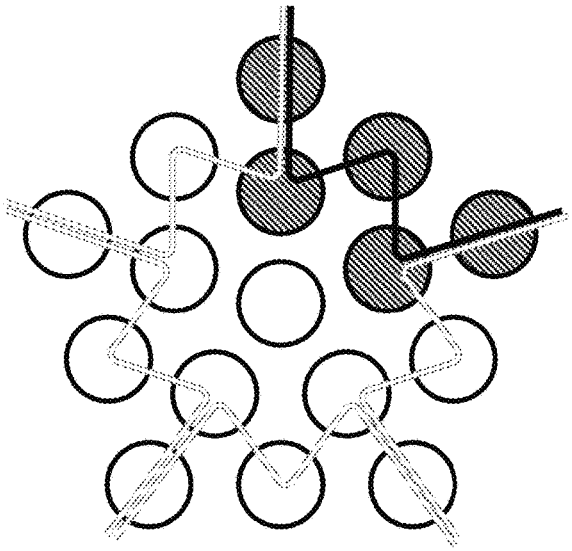

FIG. 15 depicts another payline group for a pentagonal reel or reel window arrangement, this time with "W" paylines that may be grouped together into a "radiant star" pattern.

Figure 16:
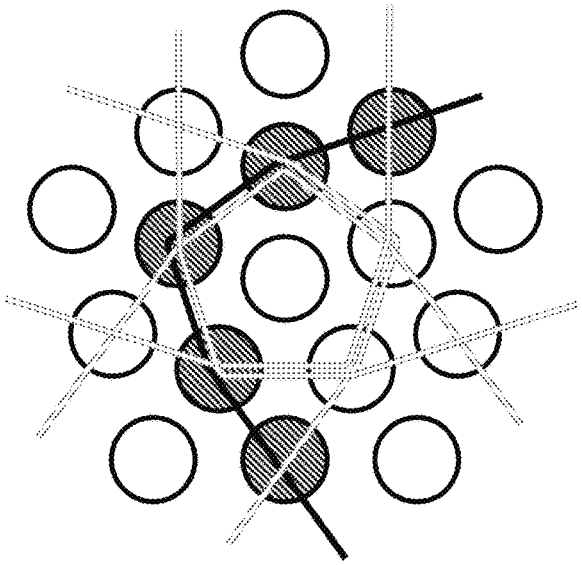

FIG. 16 depicts another payline group for a pentagonal reel or reel window arrangement, this time with "angel fish" paylines, which have a shape similar to that of the leading edge of an angel fish. Such paylines may be grouped into a "pentagram" payline group.

Figure 17:
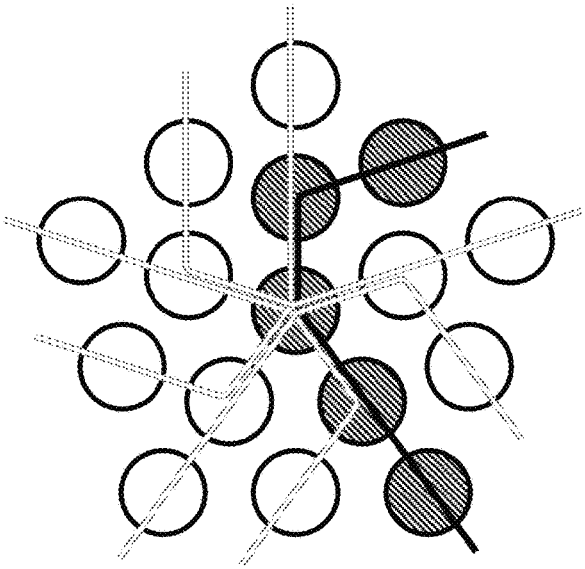
Figure 18:
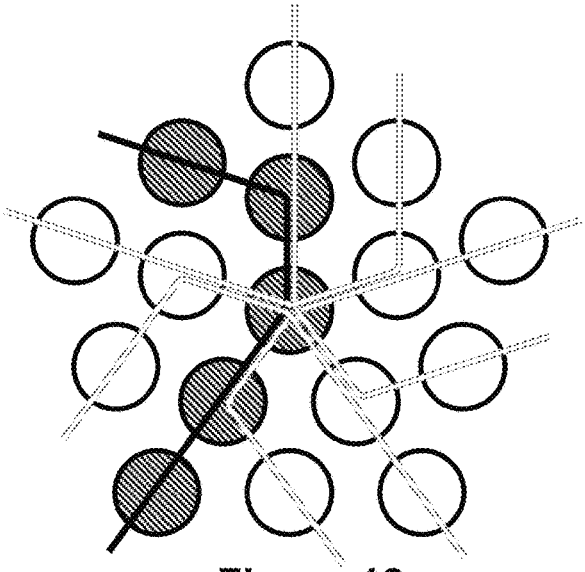

FIGS. 17 and 18 depict other payline groups for a pentagonal reel or reel window arrangement, this time with "uneven boomerang" or "crooked boomerang" paylines; the paylines shown in FIG. 18 are mirror images of those shown in FIG. 17, and the two payline groups may even be combined into a single payline group in some implementations.

Figure 19:
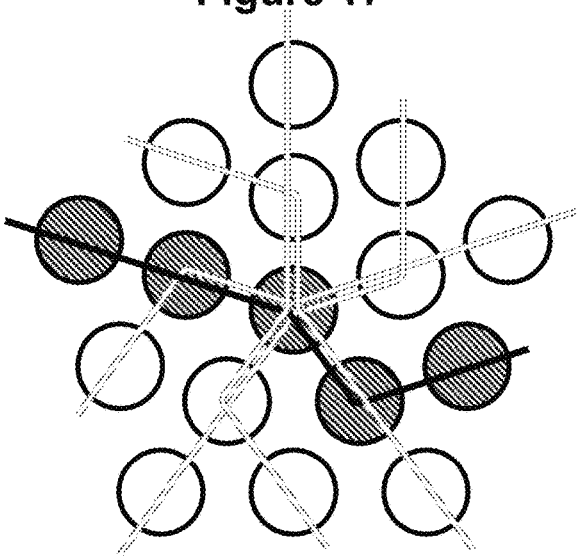
Figure 20:
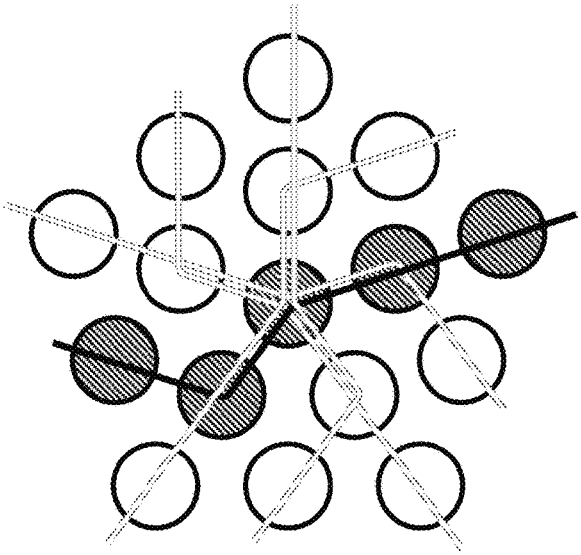

FIGS. 19 and 20 depict other payline groups for a pentagonal reel or reel window arrangement, this time with "crooked wand" or "crooked stick" paylines; the paylines shown in FIG. 20 are mirror images of those shown in FIG. 19, and the two payline groups may even be combined into a single payline group in some implementations.

FIGS. 17 and 18 depict other payline groups for a pentagonal reel or reel window arrangement, this time with "uneven boomerang" or "crooked boomerang" paylines; the paylines shown in FIG. 18 are mirror images of those shown in FIG. 17, and the two payline groups may even be combined into a single payline group in some implementations.

Figure 21:
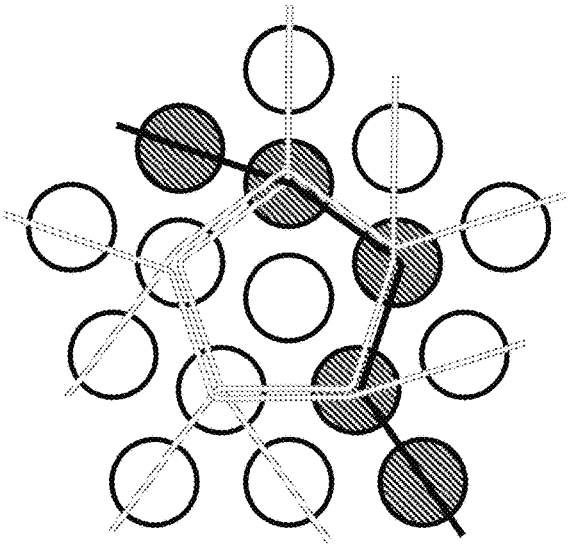
Figure 22:
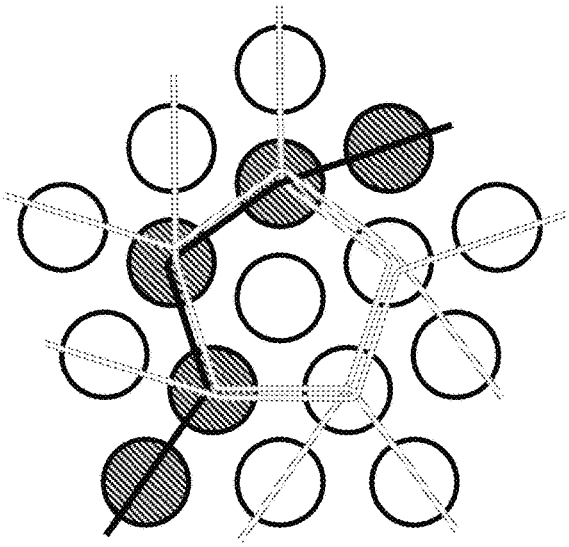
Figure 23:
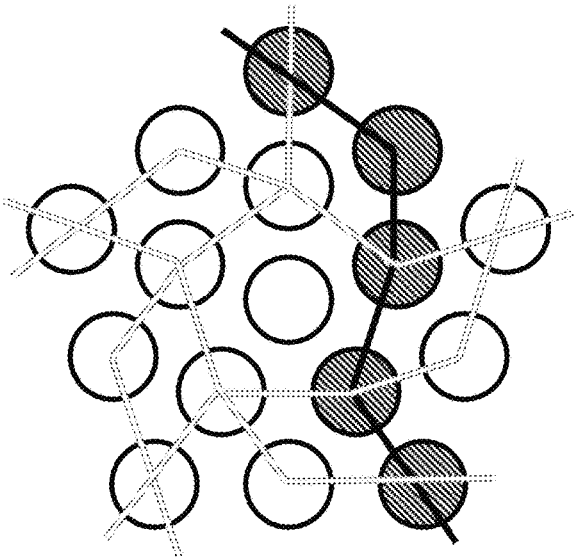
Figure 24:
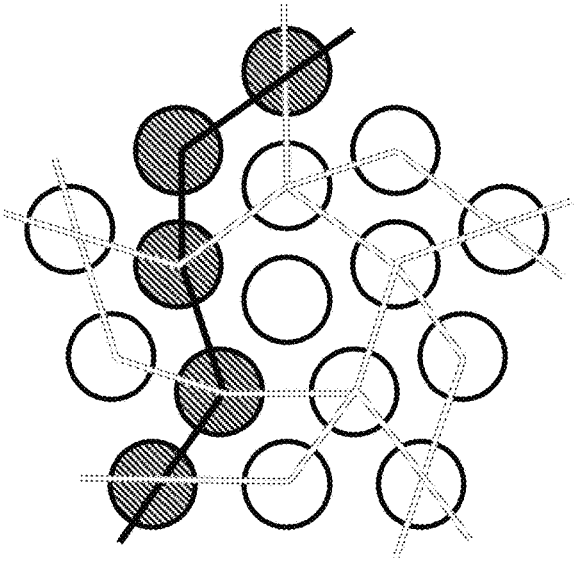

FIGS. 21 and 22 depict other payline groups for a pentagonal reel or reel window arrangement, this time with "cupped hand" paylines; the paylines shown in FIG. 22 are mirror images of those shown in FIG. 21, and the two payline groups may even be combined into a single payline group in some implementations. FIGS. 23 and 24 depict similar, although slightly different, paylines from those shown in FIGS. 21 and 22.

Figure 25:
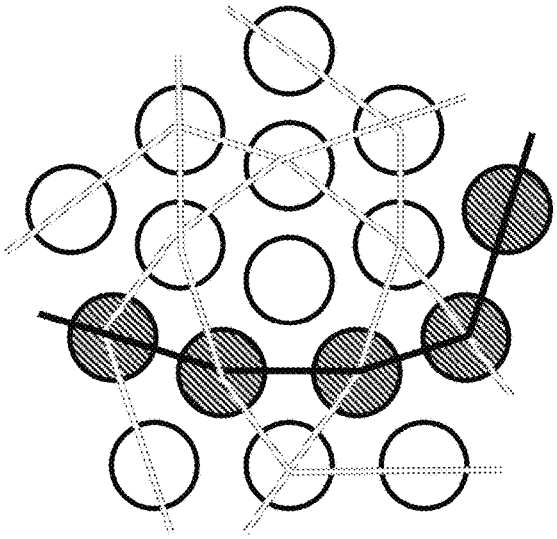
Figure 26:
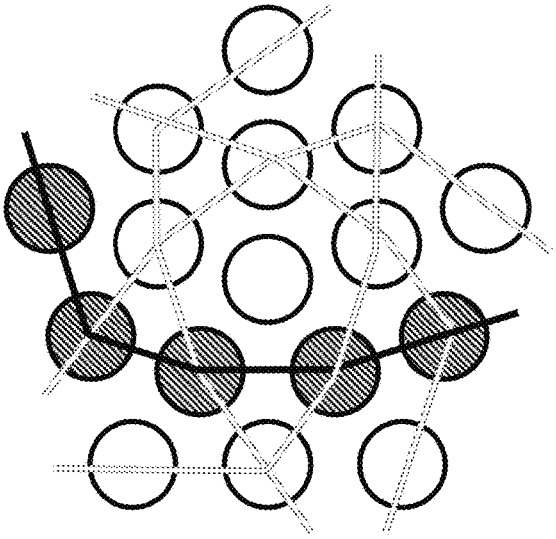

FIGS. 25 and 26 depict other payline groups for a pentagonal reel or reel window arrangement, this time with "swoosh" paylines; the paylines shown in FIG. 26 are mirror images of those shown in FIG. 25, and the two payline groups may even be combined into a single payline group in some implementations.

As will have been clear from the above, paylines that are asymmetric across an axis of radial symmetry in the reel or reel window arrangement, as is the case for the paylines depicted in FIGS. 17 through 26, may alternatively or additionally be presented in the mirror image.

As will be apparent from the above discussion and examples (which are not exhaustive), there are a large number of different paylines that may be configured for use with a pentagonal reel layout—far more than may be typically provided on a standard, rectangular- or quadrilateral-format slot machine. For example, in FIGS. 6 through 26, there are a total of 102 paylines depicted, whereas a typical 5×3 rectangular-format slot machine may provide on the order of 20 or so paylines. Due to the radial symmetry exhibited by the non-orthogonally arranged reel layouts discussed herein, the paylines used may, as discussed above, be clustered into payline groups that may be activated or deactivated in unison, e.g., responsive to player selection. In the case of FIGS. 6 through 26, the 102 paylines have been grouped into only 21 different payline groups (or 17 different payline groups if groups of mirror image paylines are combined). This allows a player to still easily choose amongst a large number of potential paylines without being overwhelmed with too large a number of selections. In the example discussed above with respect to FIGS. 6 through 26, a player may be provided with the opportunity to play games using up to a 102 paylines, but may only need to select between 21 different options in order to do so. As such, a non-orthogonally arranged reel layout may, in some implementations, offer a more efficient and player-friendly way to allow the player to play more paylines simultaneously, which may increase the rate of play for the player (and thus the gaming machine that the player is playing). In this case, rate of play refers to the number of credits wagered per unit time. Increasing the rate of play may allow the gaming machine to, on average, generate revenue at a greater rate than may be achievable using rectangularly or quadrilaterally arranged slot machines.

At the same time, groups of radially arranged paylines in a non-orthogonally arranged reel layouts may provide a much more visually appealing and attractive user experience to a player than paylines used in rectangular or quadrilateral format slot machine reel layouts.

Figure 27:
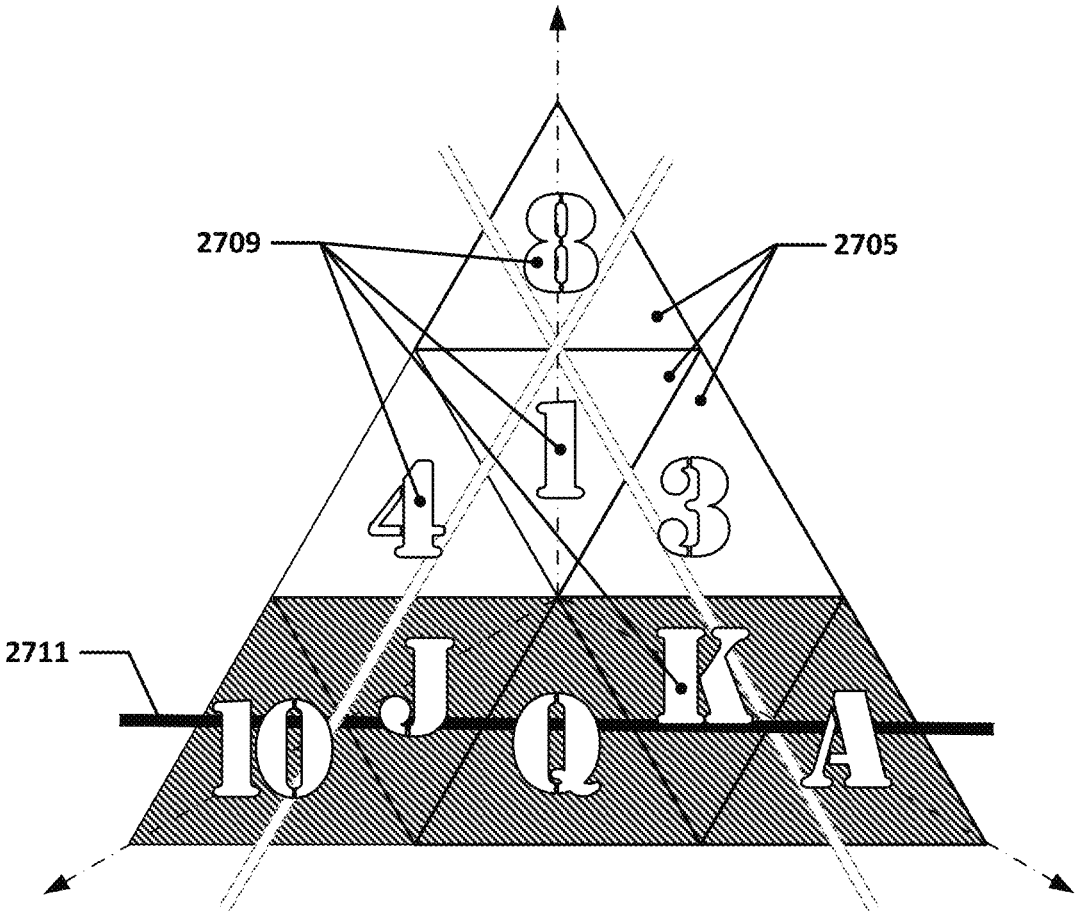
FIGS. 27 through 29 depict a triangular reel arrangement or layout.
Figure 28:
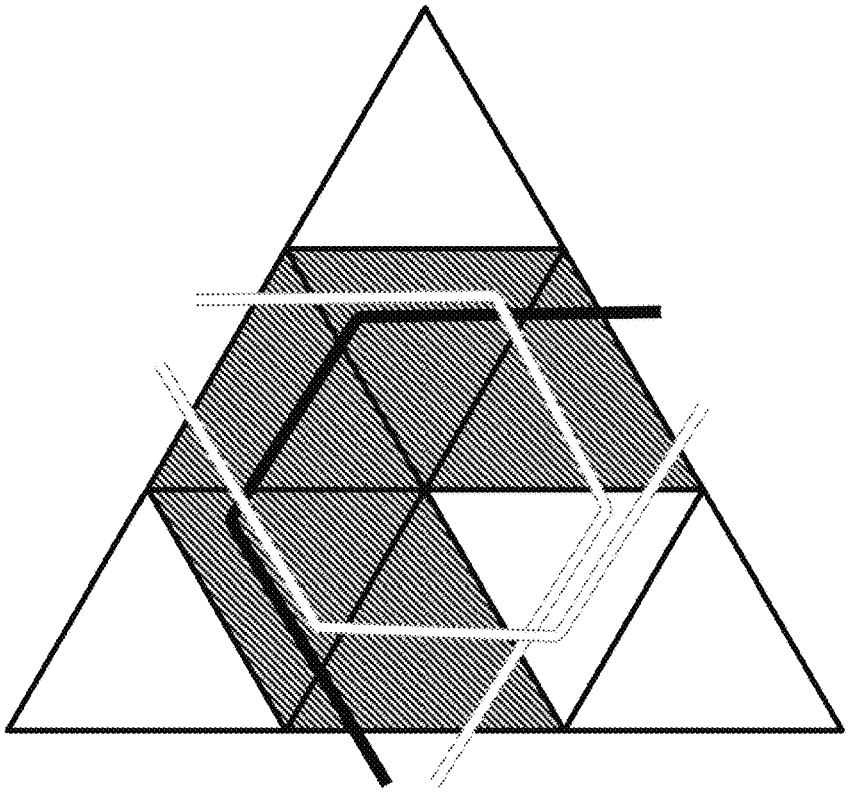
Figure 29:
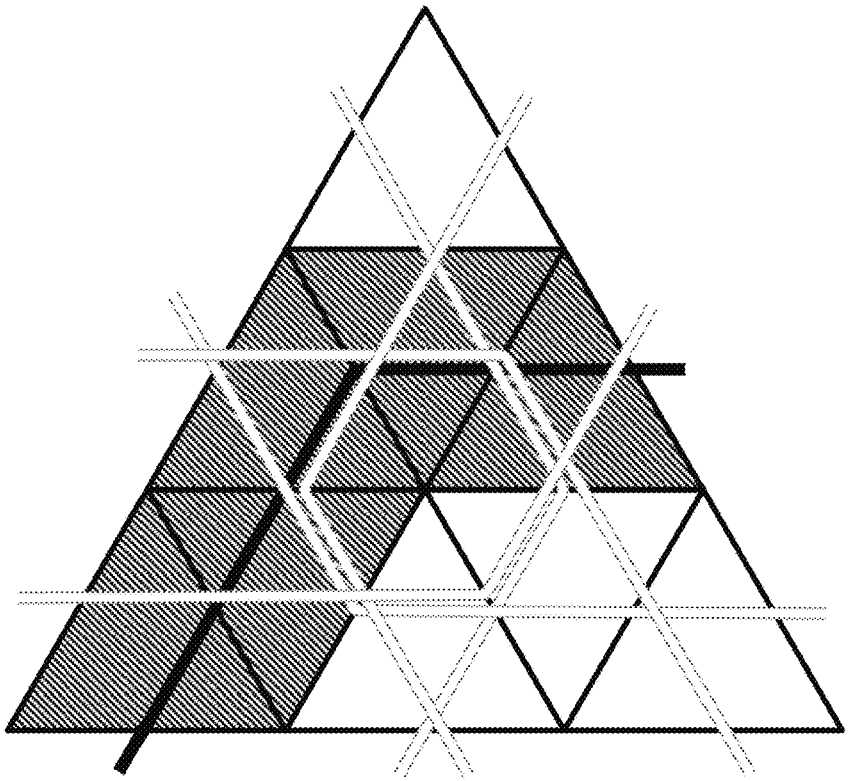

While FIGS. 5 through 26 depicted a pentagonal reel arrangement or layout, FIGS. 27 through 29 depict a triangular reel arrangement or layout. In FIG. 27, there are nine reels laid out in a triangular pattern, with reel stops 2709 visible through reel windows 2705. In this case, the triangular reel arrangement has a non-orthogonal layout with a highest-order N-fold radial symmetry of value N=3; the dash-dot-dash lines with arrows at the end radiating outward from the center of the triangular layout of reels in FIG. 27 indicate the three radial symmetry axes. The actual reel stops 2709 and the radial symmetry lines shown in FIG. 27 are omitted in FIGS. 28 and 29. As with the pentagonal reel layout discussed above, multiple paylines are shown in each of FIGS. 27 through 29, but only one payline in each Figure is depicted in solid black, with the reel windows that intersect that payline shaded to indicate a winning pattern (in the case of FIG. 27, a "royal flush" combination of symbols, although other games of chance may use other symbols and other winning patterns may be used).

In FIG. 27, three paylines 2711 are shown, each passing through five reels/reel windows 2705. The paylines are generally straight, and extend through all of the reel windows 2705 and reel stops 2709 along each edge of the triangular layout.

In FIG. 28, another three paylines are shown, each having a generally trapezoidal shape and passing through five of the centermost six reel windows, and in FIG. 29, yet another three paylines are shown, this time each having a chevron shape.

As with the paylines shown in FIGS. 5 through 26, the paylines shown in FIGS. 27 through 29 may be grouped together, as shown in FIGS. 27 through 29, into groups consisting of radial arrayed instances of the same payline. Players may be provided with the opportunity to select paylines individually and/or by payline groups, depending on the implementation.

Figure 30:
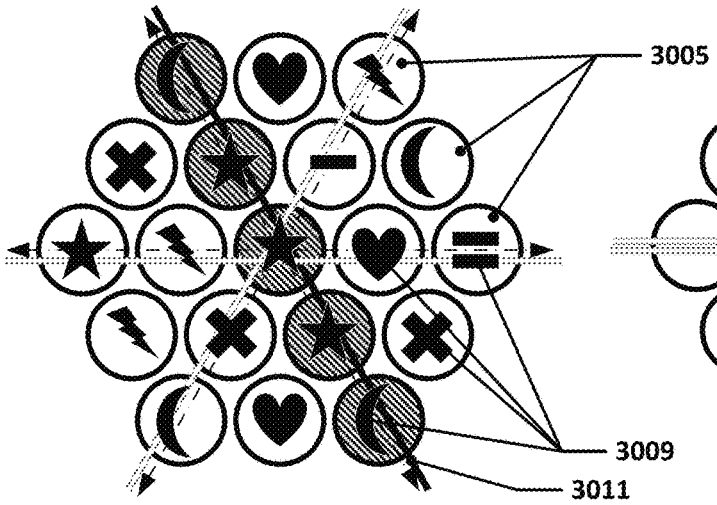
FIGS. 30 through 46 depict another example of a reel layout featuring non-orthogonally arranged reels, e.g., a hexagonal layout having highest-order N-fold radial symmetry with N=6.

FIGS. 30 through 46 depict another example of a reel layout featuring non-orthogonally arranged reels. In this instance, the non-orthogonal reel layout is a hexagonal layout having highest-order N-fold radial symmetry with N=6. As can be seen in FIG. 30, such a reel layout may allow, for example, for 19 reels to be included, although fewer or more reels may be included, depending on the particular configuration implemented.

In FIG. 30, the hexagonal reel layout may include reels with reel stops 3009 visible through reel windows 3005. In this example, three "linear" paylines 3011 are shown, with each payline 3011 passing through the centermost reel window 3005 and extending through opposing corner reel windows 3011 of the reel arrangement. The reel arrangement has radial symmetry axes indicated by the dash-dot-dash arrows, although these symmetry axes are not replicated in FIGS. 31 through 46. As with previous examples, the reel stops 3009 shown in FIG. 30 are not depicted in the remaining Figures, but such reel stops (or other reel stops) are to be understood as being visible through the reel windows 3005 during play of a slot machine featuring such a non-orthogonal reel layout. Also, as with the previous examples, only one example winning combination is shown along one payline (colored black to facilitate identification in the figures), as indicated by the shaded reel windows 3105; this convention is followed for the following Figures as well.

Figure 31:
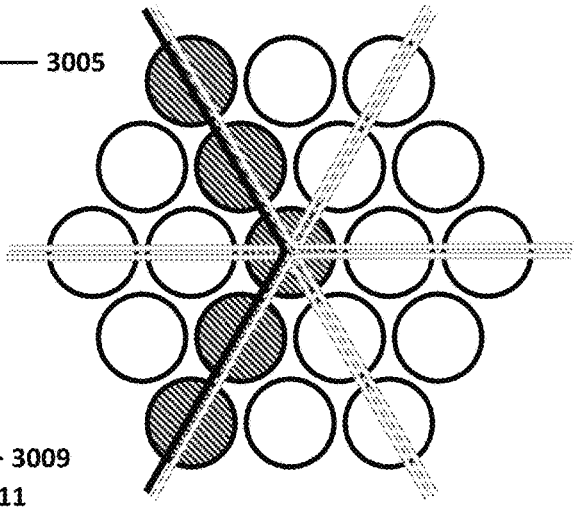

FIG. 31 depicts the hexagonal reel layout of FIG. 30, but with six "inward chevron" paylines that are arranged in a radial array. In some implementations, such paylines may be grouped together into a "woven asterisk" payline group.

Figure 32:
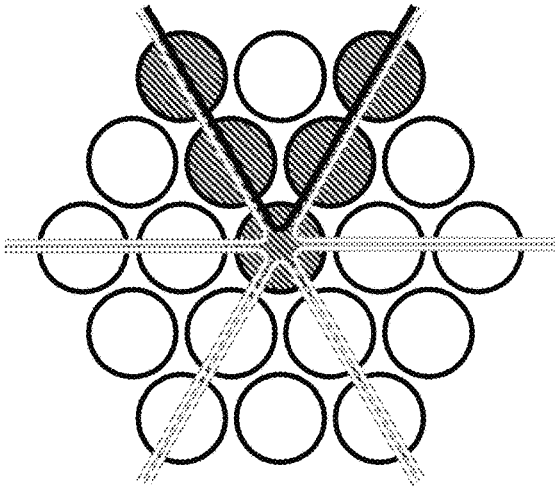

FIG. 32 depicts the hexagonal reel layout of FIG. 30, but with six "sextant" paylines depicted. In some implementations, such paylines may be grouped together into an "asterisk" payline group.

Figure 33:
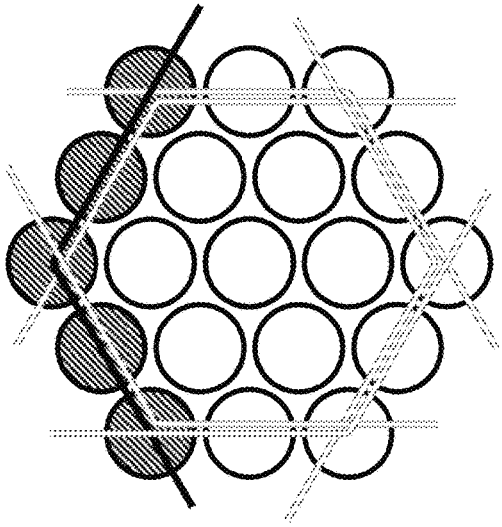

FIG. 33 depicts the hexagonal reel layout of FIG. 30, but with six "exterior outward chevron" paylines depicted. In some implementations, such paylines may be grouped together into a "hexagon" or "outer hexagon" payline group.

Figure 34:
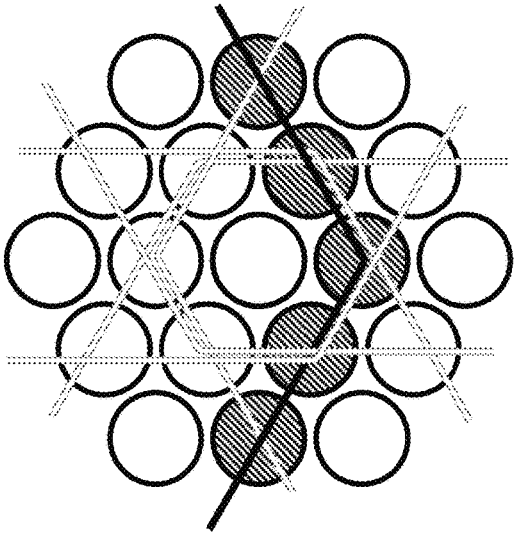

FIG. 34 depicts the hexagonal reel layout of FIG. 30, but with six "interior outward chevron" paylines depicted. In some implementations, such paylines may be grouped together into a "hexagon" or "inner hexagon" payline group.

Figure 35:
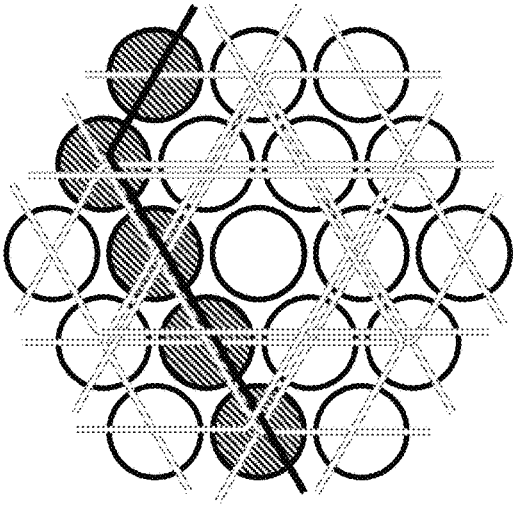

FIG. 35 depicts the hexagonal reel layout of FIG. 30, but with 12 "asymmetric chevron" paylines depicted—in this case, in two radial arrays, one having mirror images of the asymmetric chevron paylines of the other. In some implementations, such paylines may be grouped together into a "snowflake" payline group.

Figure 36:
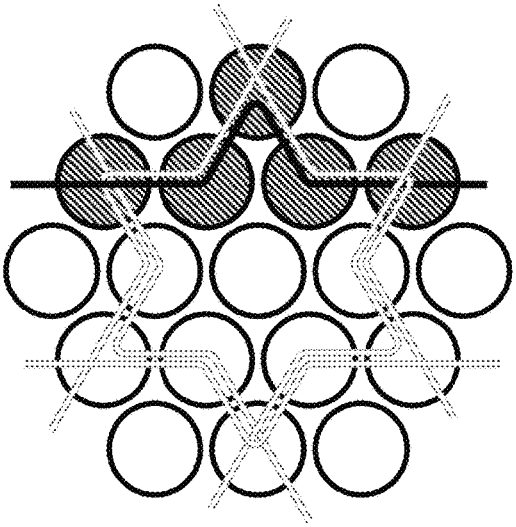

FIG. 36 depicts the hexagonal reel layout of FIG. 30, but with six "outward sombrero" paylines depicted. In some implementations, such paylines may be grouped together into a "star" or "open star" payline group.

Figure 37:
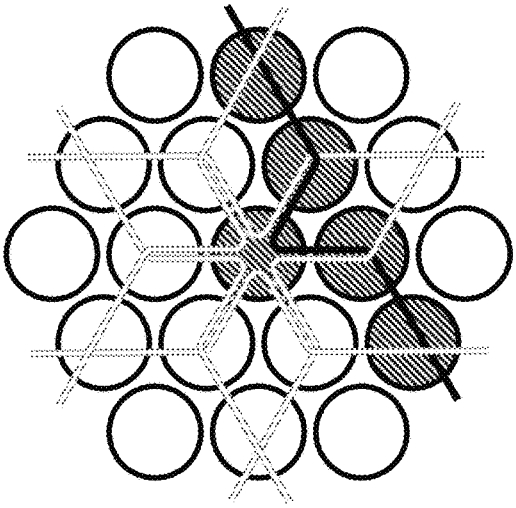

FIG. 37 depicts the hexagonal reel layout of FIG. 30, but with six "inward sombrero" paylines depicted. In some implementations, such paylines may be grouped together into a "faceted star" payline group.

Figure 38:
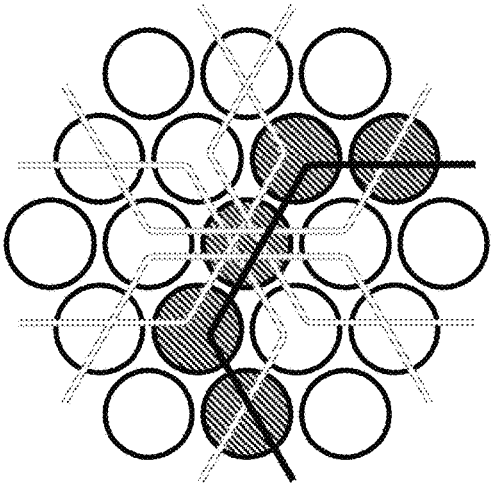

FIG. 38 depicts the hexagonal reel layout of FIG. 30, but with six "trapezoid" paylines depicted. In some implementations, such paylines may be grouped together into a "star" payline group.

Figure 39:
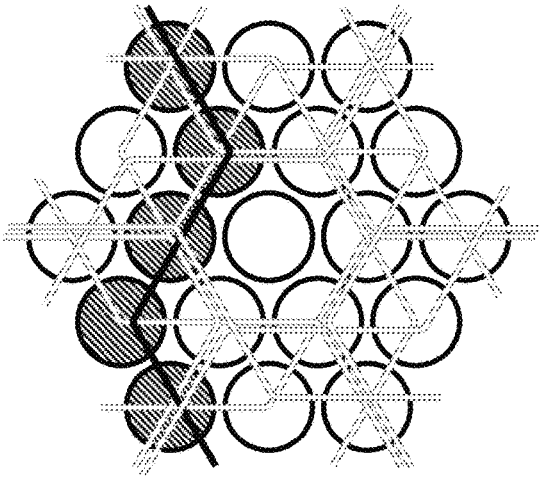

FIG. 39 depicts the hexagonal reel layout of FIG. 30, but with 12 "exterior S" paylines depicted—in this case, in two radial arrays, one having mirror images of the exterior S paylines of the other. In some implementations, such paylines may be grouped together into an "annular hexagon" payline group.

Figure 40:
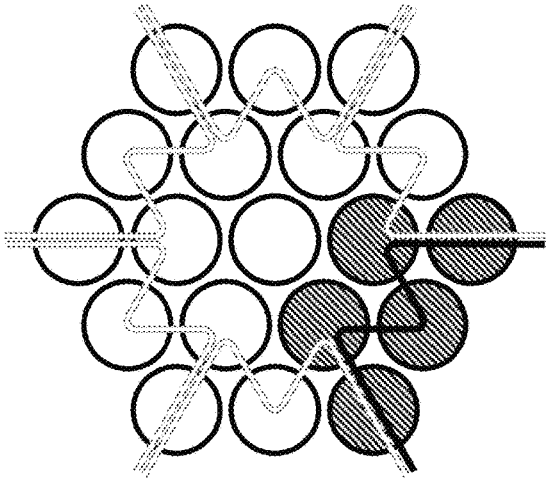

FIG. 40 depicts the hexagonal reel layout of FIG. 30, but with six "W" paylines depicted. In some implementations, such paylines may be grouped together into a "radiant star" payline group.

Figure 41:
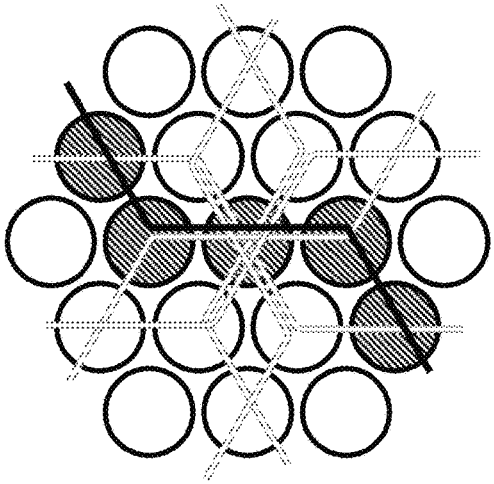

FIG. 41 depicts the hexagonal reel layout of FIG. 30, but with six "interior S" paylines depicted. In some implementations, such paylines may be grouped together into a "faceted star" payline group.

Figure 42:
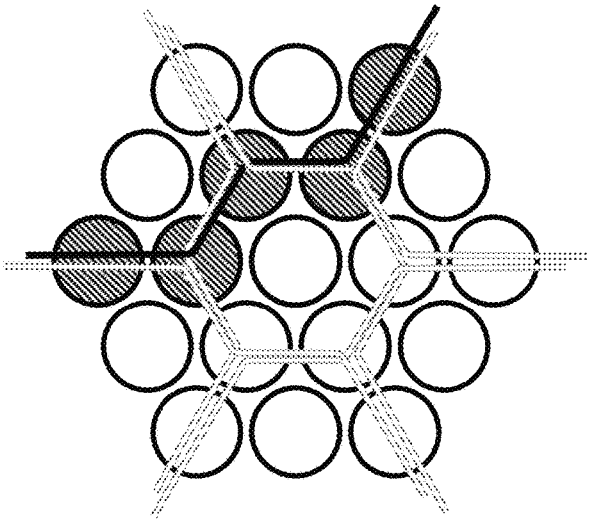

FIG. 42 depicts the hexagonal reel layout of FIG. 30, but with six "shallow W" paylines depicted. In some implementations, such paylines may be grouped together into a "radiant hexagon" payline group.

Figure 43:
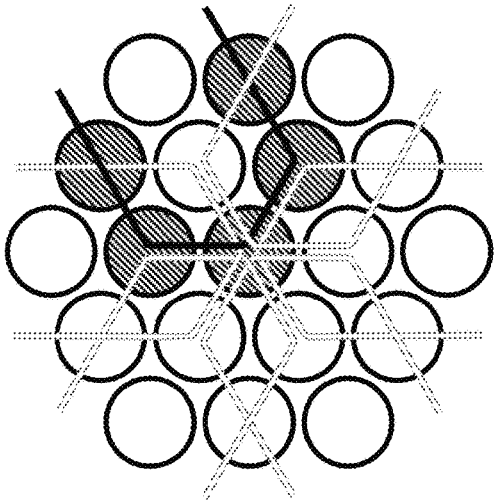

FIG. 43 depicts the hexagonal reel layout of FIG. 30, but with six "U" paylines depicted. In some implementations, such paylines may be grouped together into a "faceted star" payline group.

Figure 44:
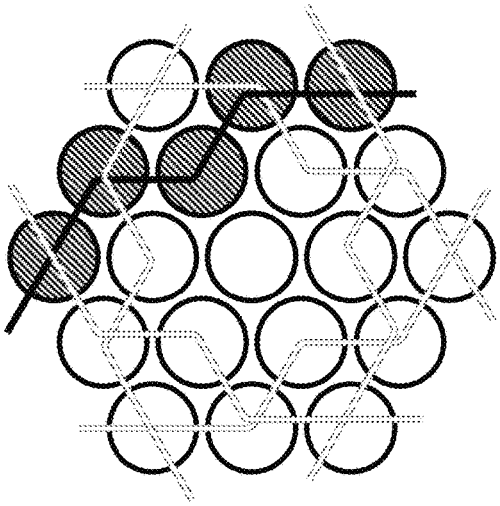

FIG. 44 depicts the hexagonal reel layout of FIG. 30, but with six "trapezoid" paylines depicted. In some implementations, such paylines may be grouped together into a "star" payline group.

Figure 45:
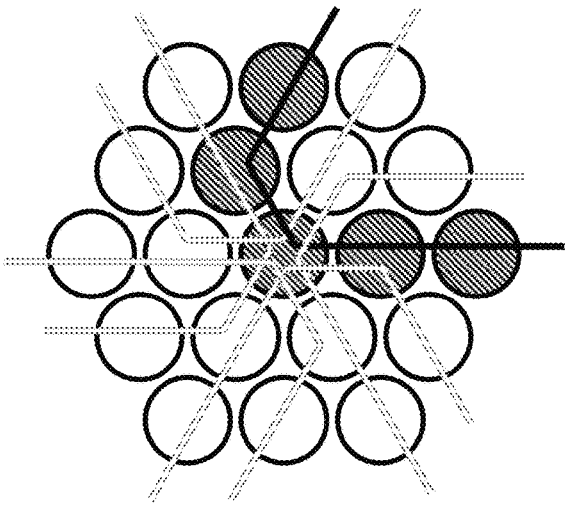
Figure 46:
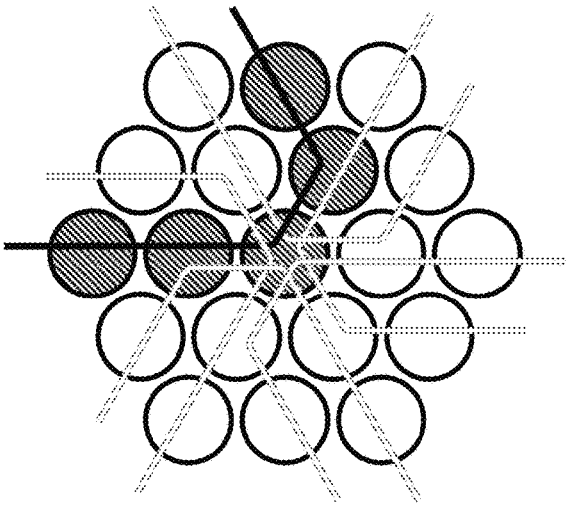

FIGS. 45 and 46 each depict the hexagonal reel layout of FIG. 30, but with six "uneven trapezoid" paylines depicted in each; the uneven trapezoid paylines in FIG. 45 are mirror images of those in FIG. 46. In some implementations, the paylines of such Figures may be grouped together into "pinwheel" payline groups. In some implementations, these payline groups into a "pinwheel star" payline group.

As will be evident, one characteristic of non-orthogonal reel layouts with N-fold radial symmetry of N>4, as discussed herein, is that some such layouts may feature reels/reel windows that lie along a single linear path from one side of the layout to another, non-adjacent side of the layout, e.g., such as the hexagonal reel layout, in which five reels/reel windows lie along multiple linear paths passing through the center of the layout. Other non-orthogonal reel layouts with N-fold radial symmetry of N>4, however, may feature reels/reel windows that do not lie along a single linear path from one side of the layout to another, such as the pentagonal reel arrangement discussed earlier, in which there is no "straight" line arrangement of reels/reel windows from one side of the layout to another non-adjacent side of the layout.

Generally speaking, each payline for a particular game of chance may pass through the same number of reel windows. Thus, for example, in the previously discussed implementations, each payline passed through five reel windows/reels. However, it will be understood that other implementations may feature fewer or more reel windows/reels in each payline, e.g., four reels/reel windows or six reels/reel windows. In some implementations, due to the increased flexibility with payline definition provided by non-orthogonal reel layouts, a particular game of chance may feature paylines with different numbers of reels/reel windows. For example, a non-orthogonal reel layout may support paylines with five reel windows/reels, as well as some paylines with six reel windows/reels.

In some implementations, multiple non-orthogonally arranged reel layouts may be implemented in a game of chance and, for example, laid out so as to be side-by-side or, in some implementations, share one or more sides. In such games of chance, in addition to potentially separate sets of paylines for each such reel layout, there may also be paylines that span multiple reel layouts. Such "meta-paylines" or "super-paylines" may, for example, provide awards or payouts that are much higher than may be achieved with paylines belonging to a particular reel layout.

Figure 47:
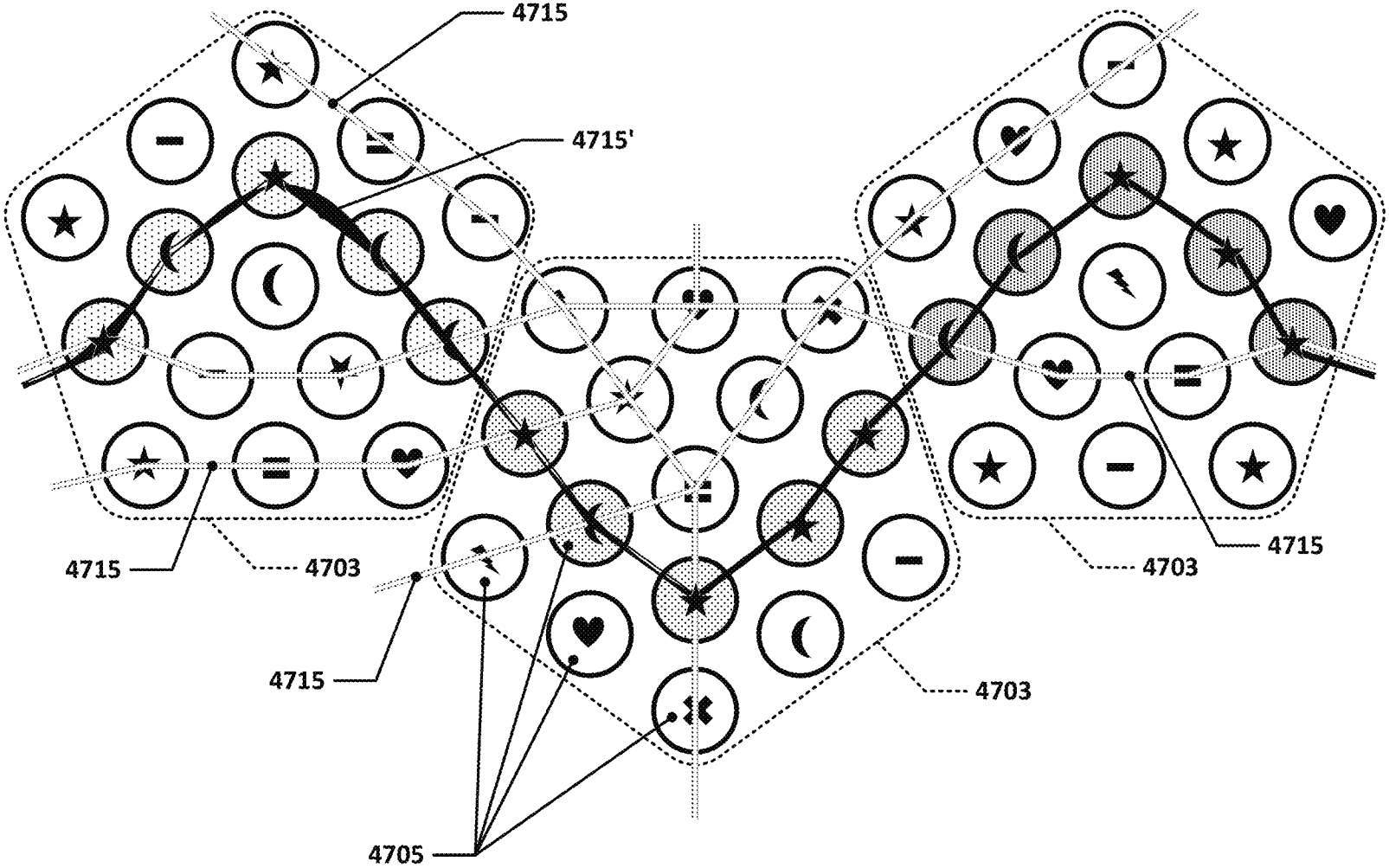
FIG. 47 depicts one example of an arrangement of multiple non-orthogonally arranged reel layouts.

FIG. 47 depicts one example of an arrangement of multiple non-orthogonally arranged reel layouts. In this example, three pentagonal reel layouts 4703 having 16 reels/reel windows 4705 each have been arranged such that opposing sides of the central layout are adjacent to corresponding sides of the two flanking layouts. Each such pentagonal layout may allow for prizes to be awarded for winning patterns along layout-specific paylines, e.g., such as those discussed with respect to FIGS. 5 through 26, but may also award larger-magnitude prizes for winning patterns along meta-paylines 4715, which may pass through multiple pentagonal reel layouts 4703. In some instances, a meta-payline may be formed by chaining together multiple layout-specific paylines, e.g., the metapayline 4715' includes three "angel fish" paylines chained together end-to-end. In some such implementations, the meta-payline 4715' may be achieved simply by obtaining any three winning patterns (and/or any three winning amounts) along the three "angel fish" paylines, even if each such "angel fish" payline wins due to a different winning pattern.

Figure 48:
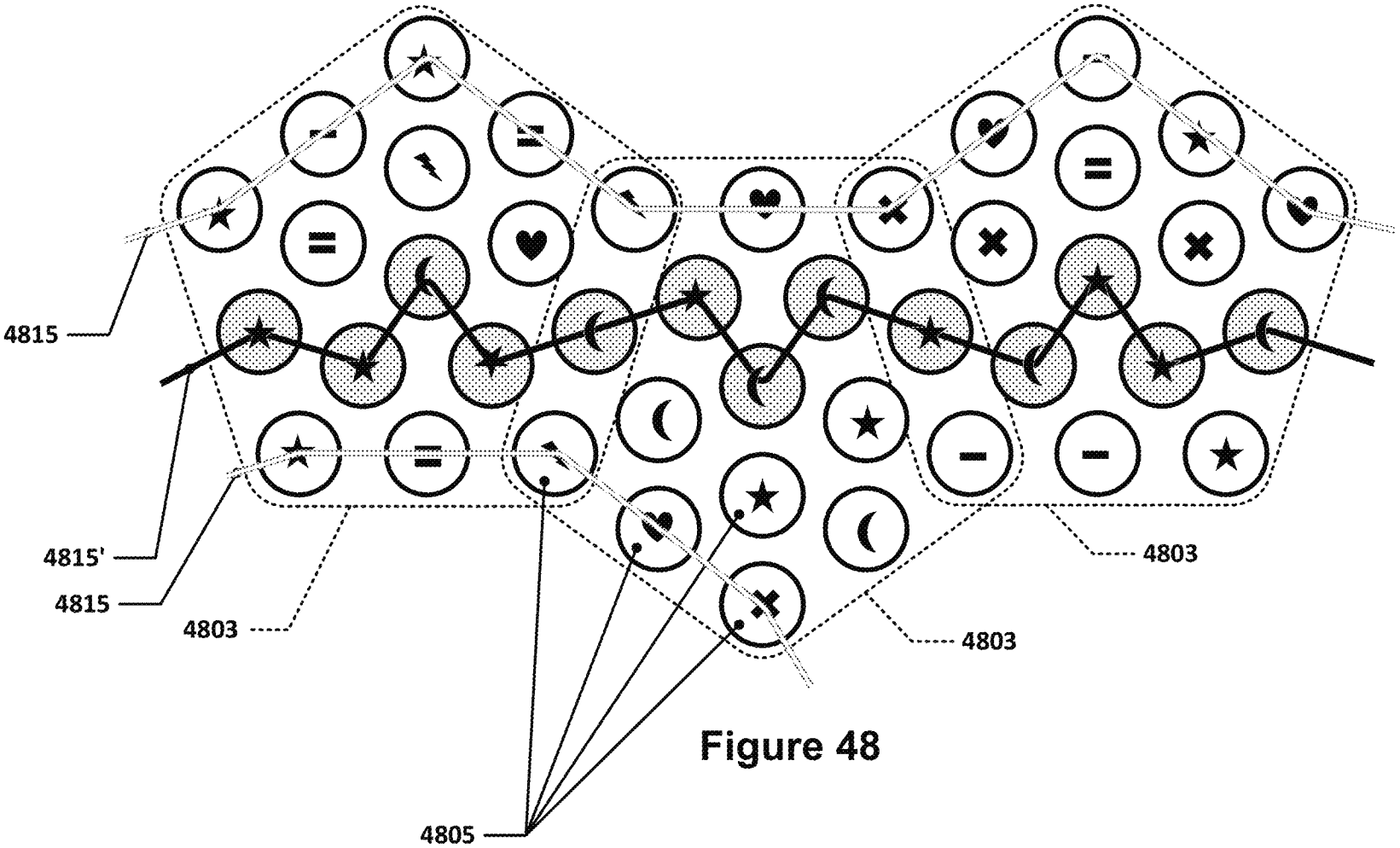
FIG. 48 depicts a similar arrangement of multiple pentagonal reel layouts as in FIG. 47, but with each pentagonal layout sharing reels with the adjacent pentagonal layout(s) along a common edge/side.

FIG. 48 depicts a similar arrangement of multiple pentagonal reel layouts 4803, but with each pentagonal layout 4803 sharing reels with the adjacent pentagonal layout(s) 4803 along a common edge/side. This arrangement may be more compact that that shown in FIG. 47, although the meta-paylines 4815 may be more inter-dependent. For example, if a meta-payline 4815' is provided that "chains" together discrete paylines for each of the pentagonal reel layouts, those the ends where two paylines link up may share reel stops. Thus, if a winning pattern of a meta-payline may be obtained by obtaining winning patterns for each of a chain of layout-specific paylines, those winning patterns may be somewhat interdependent since they may share starting and/or ending reel stops.

In some implementations, a non-orthogonal reel arrangement or layout, or a portion thereof, may be rotatable or otherwise transformed after reel stops are determined in order to re-orient winning patterns or partial winning patterns so as to align them with other game elements—for example, to align them with non-moving reel windows/reel positions, with bonus elements, or with portions of other paylines on adjacent reel layouts in order to form a winning pattern along a meta-payline.

Figure 49:
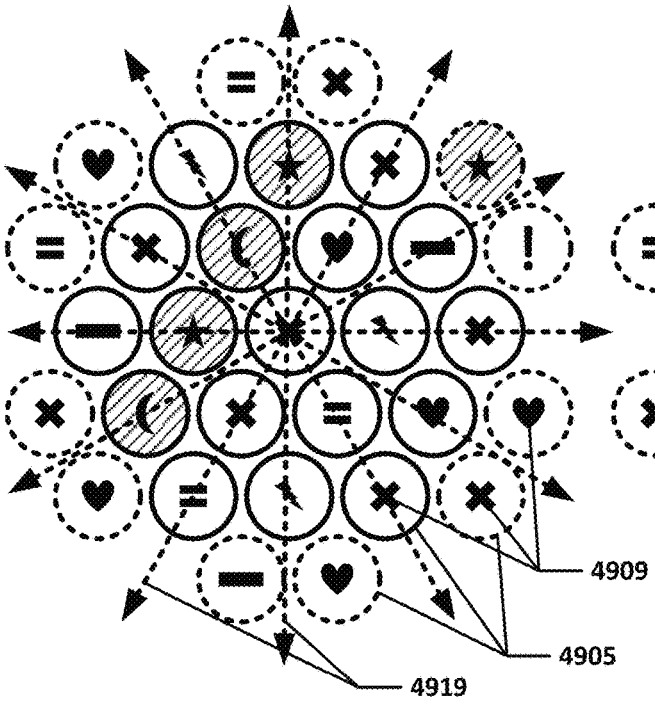
FIGS. 49 through 52 depict an example of a reel layout that has movable or transformable reel/reel window locations.
Figure 50:
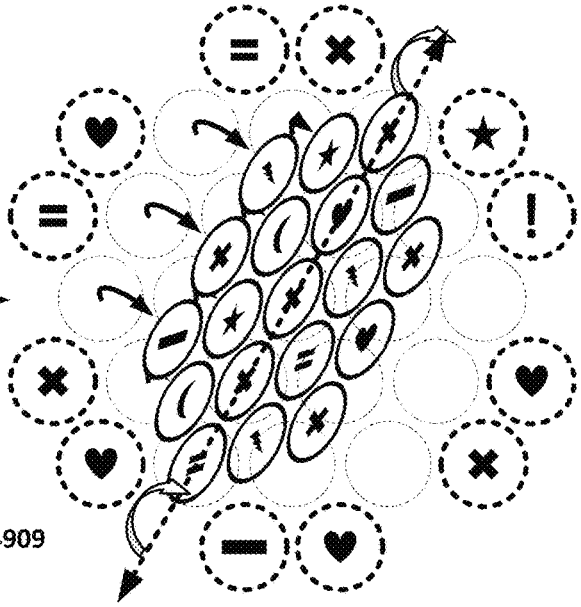
Figure 51:
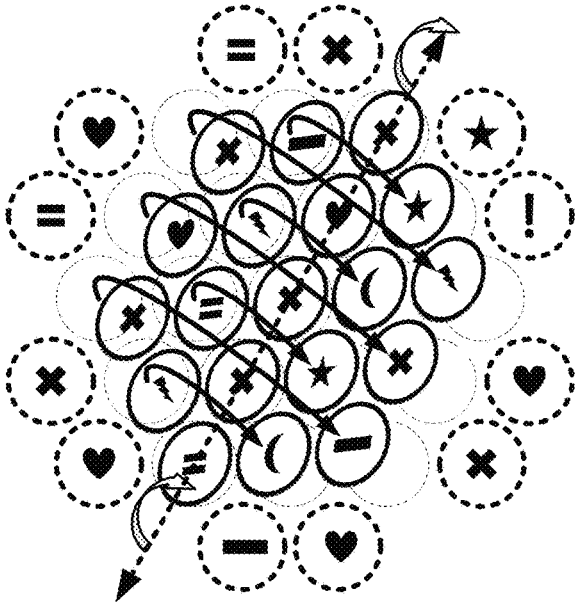
Figure 52:
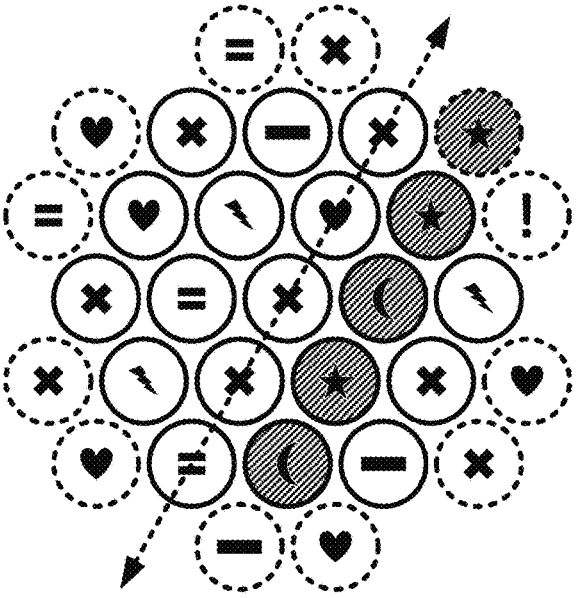
Figure 53:
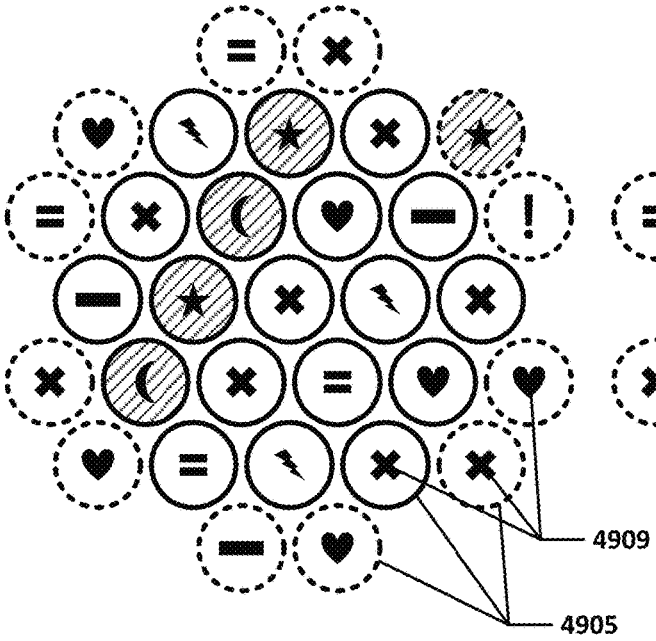
FIGS. 53 through 56 depict an example of a reel layout that has movable or transformable reel/reel window locations, similar to the reel layout of FIG. 49.
Figure 54:
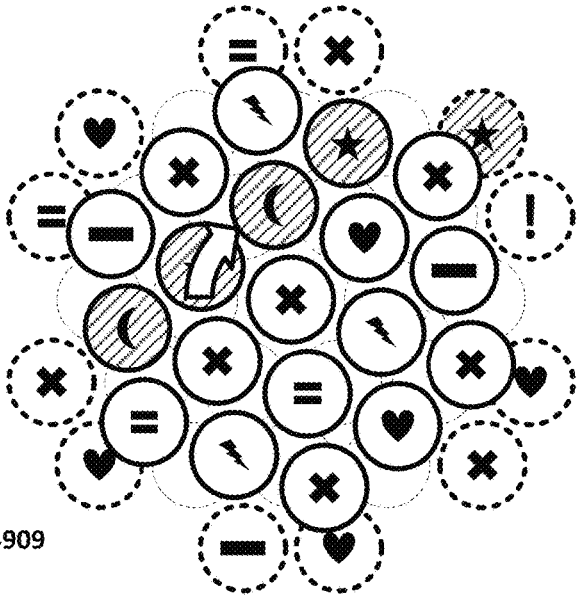
Figure 55:
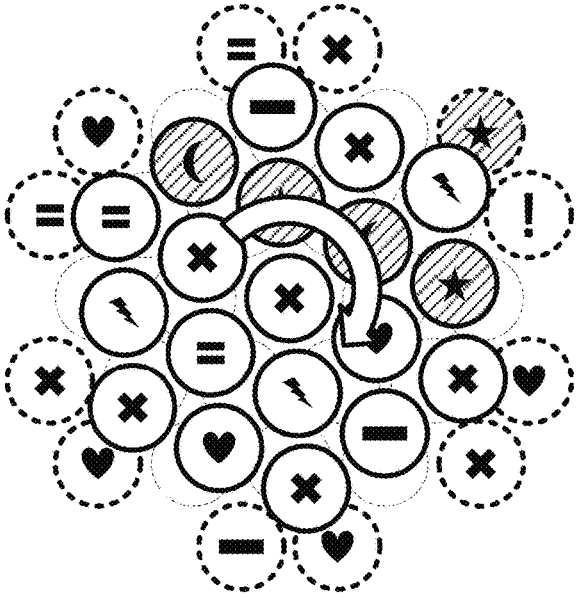
Figure 56:
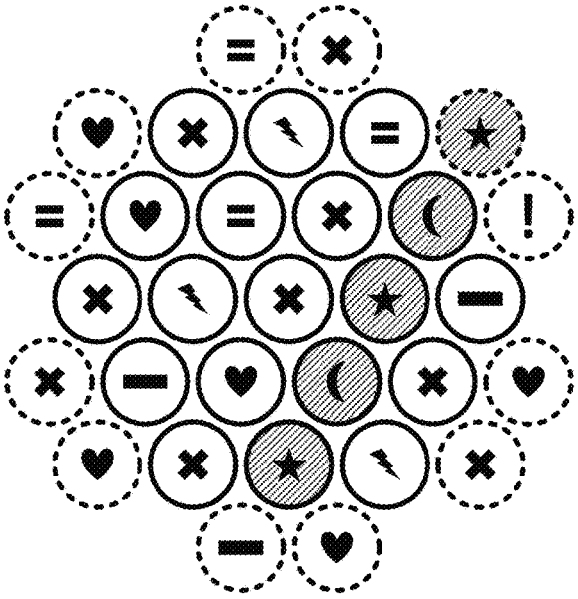

FIGS. 49 through 52 depict an example of a reel layout that has movable or transformable reel/reel window locations. In FIG. 49, a reel layout with 6-fold highest-order radial symmetry is provided; this reel layout features 19 interior reels/reel windows 4905 having reel stops 4909 that may be transformed by rotating or flipping those reels/reel windows/reel stops about any of several bilateral symmetry axes 4919, or otherwise causing those reels/reel windows/reel stops to swap places with the reels/reel windows/reel stops that are located the same distance from the bilateral symmetry axis on the opposite side of the bilateral symmetry axis and along an axis that is perpendicular to the bilateral symmetry axis and that passes through each swapped pair of reels/reel windows/reel stops. In FIG. 49, all six of the bilateral symmetry axes 4919 for the depicted reel layout are shown, although other implementations may utilize a reduced number of bilateral symmetry axes, e.g., only a subset of the possible bilateral symmetry axes for a given reel layout. Also shown in FIG. 49 are an additional 12 reels/reel windows that are not part of the transformable portion of the reel layout; these "stationary" reels/reel windows have dotted outlines in FIG. 49.

In FIG. 49, a player has achieved a partial winning pattern of a straight line of four stars and/or moons (shaded with diagonal hatching), but in order to actually achieve the winning pattern in this example game of chance, a straight line of five stars and/or moons is required. In some implementations of non-orthogonally arranged reel layout games of chance, the player may be provided the opportunity to modify or adjust the reel layout by swapping reels/reel windows/reel stops across one of the bilateral symmetry axes. For example, in FIG. 50, the player has elected to "flip" or "rotate" the interior reels/reel windows/reel stops around a particular, selected bilateral symmetry axis so as to align the partial winning pattern with an additional reel/reel window/reel stop that would complete the winning pattern (also shown with diagonal hatching); this rotation is continued in FIG. 51 and completed in FIG. 52, where the completed winning pattern is shown. As will be evident, the reels/reel windows/reel stops located along the selected bilateral symmetry axis do not actually swap positions with any other reels/reel windows/reel stops (in fact, the middlemost reel/reel window/reel stop in this example does not swap positions with any other reels/reel windows/reel stops regardless of which bilateral symmetry axis is selected); such reels/reel windows/reel stops may still be animated as if they are undergoing the same type of transformation as the other reels/reel windows/reel stops.

It will also be understood that reference to moving, flipping, rotating, or otherwise transforming reels/reel windows/reel stops may include any graphical display that results in at least the reel stops shown in the various reel windows exchanging position with other reel stops in the reel layout, i.e., the graphical display may actually depict a flipping or rotating animation, but may also depict the positional exchange using other types of animation, e.g., simply translating the reel stops between opposing locations or simply causing the reel stop graphics in opposing reel windows to switch from one animation frame to the next (although such abrupt transformations are likely visually unappealing and may be difficult for a player to follow). The reel windows themselves may also exchange position in a similar manner, although in some implementations the reel windows may remain stationary, and an animation showing only the reel stops exchanging positions may occur. It will also be understood that for the purposes of such reel stop transformation or swapping/exchange, the reels associated with each reel stop may remain in their original positions or may also be swapped/exchanged. In most implementations, it may be preferable to simply swap the reel stops and/or reel windows to form the winning pattern, and then resume play using the same layout of reels after providing an award or prize based on the transformed reel stops.

FIGS. 53 through 56 depict an example of a reel layout that has movable or transformable reel/reel window locations, similar to the reel layout of FIG. 49. In FIGS. 53 through 56, however, the player has the option of rotating the interior reel windows about the center point (in this case, the centermost reel window) in unison by an amount of 360°/N, where N is the highest-order N-fold radial symmetry (6 in this case) of the displayed reel layout. In this case, the interior reel windows are rotated by 180° about the centermost reel window to align the four reel stops in the partial winning pattern with the additional reel stop of the stationary reel windows that completes the winning pattern, in a manner similar to that shown in FIG. 52. In some similar implementations, a continuous ring of reel windows may be rotated in unison about the center point by an amount of 360°/N, e.g., in a pentagonal arrangement of reels such as discussed with reference to FIGS. 5-26, there are two rings of reel windows encircling the center reel window—the first ring includes the five reel windows immediately adjacent to the center reel window, and the second ring includes the ten reel windows located along the outer perimeter of the layout. In such an example reel window layout, some implementations may allow for the player to rotate only the inner ring of reel windows without rotating the outer ring of reel windows, only the outer ring of reel windows without rotating the inner ring of reel windows, or both rings of reel windows independently (by different amounts and/or in opposite directions). Put more generally, the reel stops displayed in a plurality of the non-central reel windows may be caused to rotate about the center axis by the same amount so that each reel stop displayed in the plurality of non-central reel windows moves to a position occupied by the reel stop displayed in another one of the reel windows of the plurality of non-central reel windows prior to the rotation. Of course, there may be additional rings of reel windows that may be transformable as discussed above, e.g., if there is a third ring of reel windows, then this ring may also be rotatable as discussed above.

It will be understood that various implementations of games of chance with transformable reel stops may utilize transformations as shown in FIGS. 49 through 52, as shown in FIGS. 53 through 56, or combinations thereof.

Implementations of games of chance with transformable reel stops may be implemented in a number of different ways providing more or less player control. For example, in some implementations, such games of chance may be configured evaluate a given arrangement of reel stops and, if any partial winning patterns are evident, determine if a permitted transformation of reel stops would cause a partial winning pattern to turn into a complete winning pattern. If so, then the gaming machine offering the game of chance may cause the transformation to occur. In cases where multiple winning patterns may be achievable depending on which transformation is performed, such gaming machines may, in some instances, select the transformation that achieves a winning pattern or patterns that maximize the player award or prize. In other such instances, such gaming machines may randomly select between transformations that result in different awards or prizes being awarded.

In some implementations, such reel stop transformations may be automatic, but may only be performed responsive to certain conditions being met (other than the condition that a winning pattern is achievable through performing a permitted transformation). For example, a player may earn one or more "transformation chances" through play of the game of chance; such transformation chances may serve as a form of currency that may govern whether a transformation is automatically performed. If a player achieves a partial winning pattern that may be transformed into a winning pattern by performing a particular reel stop transformation, the gaming machine may first determine whether the player has sufficient transformation chances to "pay" for the transformation. If so, then the gaming machine may implement the transformation and reduce the transformation chances by a corresponding amount. In some implementations, there may be a 1:1 relationship between the performance of a transformation and the amount of transformation chances needed to perform the transformation. In other implementations, however, certain transformations may be assigned a higher number of transformation chances that may be needed in order to perform the transformation. For example, some transformations may require that the player have/expend two transformation chances, whereas other transformations may require that the player only have/expend one transformation chance in order to perform the transformation.

In some implementations having transformation chances, the transformation chances may be awarded as a bonus (as the result of play of a bonus game), through normal play (as the result of particular reel stops appearing in one or more reel windows), as a reward offered due to the player's use of a player tracking system, and/or through the player purchasing them (e.g., by exchanging credits for one or more such transformation chances).

In addition to gaming machines that automatically determine reel stop transformations and implement them, some gaming machines may allow for more player control. For example, in some gaming machines, the gaming machine may not automatically select or implement a given transformation, but may instead provide the player with an opportunity to select and apply a transformation. In such implementations, the gaming machine may provide varying levels of feedback/assistance to the player. In some such implementations, for example, the gaming machine may provide no real assistance to the player, and simply allow the player to select and implement a transformation at will without any guidance. In more helpful implementations, the gaming machine may be configured to only provide the player with the opportunity to implement a transformation if doing so would allow the player to achieve a winning pattern (or a more superior winning pattern from what may already have been achieved). In such implementations, the gaming machine may also highlight (or only permit the player to choose from) the possible transformations that may result in or enhance a winning pattern. The gaming machine may, however, refrain from indicating which particular transformation of multiple possible "winning" transformations will have the most beneficial effect, thereby introducing some element of skill in that the player must be able to determine which transformation may be most beneficial.

In some implementations where the player is able to control the selection/application of reel stop transformations, the ability to do so may be subject to the "transformation chance" mechanism discussed above, i.e., the player may only be able to do so if they have sufficient transformation chances accrued with which to purchase a particular reel stop transformation. As discussed above, such transformation chances may be purchased or earned through a variety of different avenues, depending on the particular implementation. In systems offering player-controlled reel-stop transformations, there may be limits on how many transformation chances may be accrued at a time, or in how many transformation chances may be expended within a given time period. For example, there may be a limit of 5 transformation chances that can be accrued at any given time (thus preventing excessive stockpiling of transformation chances) or a limit of 5 transformation chances that may be expended each hour (thus allowing the player to make a strategic decision as to when to make use of a transformation chance—the player will need to balance the benefit of utilizing a transformation chance for a present opportunity to enhance their winnings with the potential for a lost opportunity to do so later for potentially greater reward). If the player opts to apply a reel stop transformation, the player may select one or more inputs of the gaming machine in order to generate a signal that causes the gaming machine to select the desired reel stop transformation and apply it to the displayed reel stops.

In implementations such as those shown in FIGS. 47 and 48 where there are multiple reel layouts positioned side-by-side or overlapping one another, reel stop transformations may, for example, be implemented to allow reel stops to be moved so as to complete meta-paylines.

Figure 57:
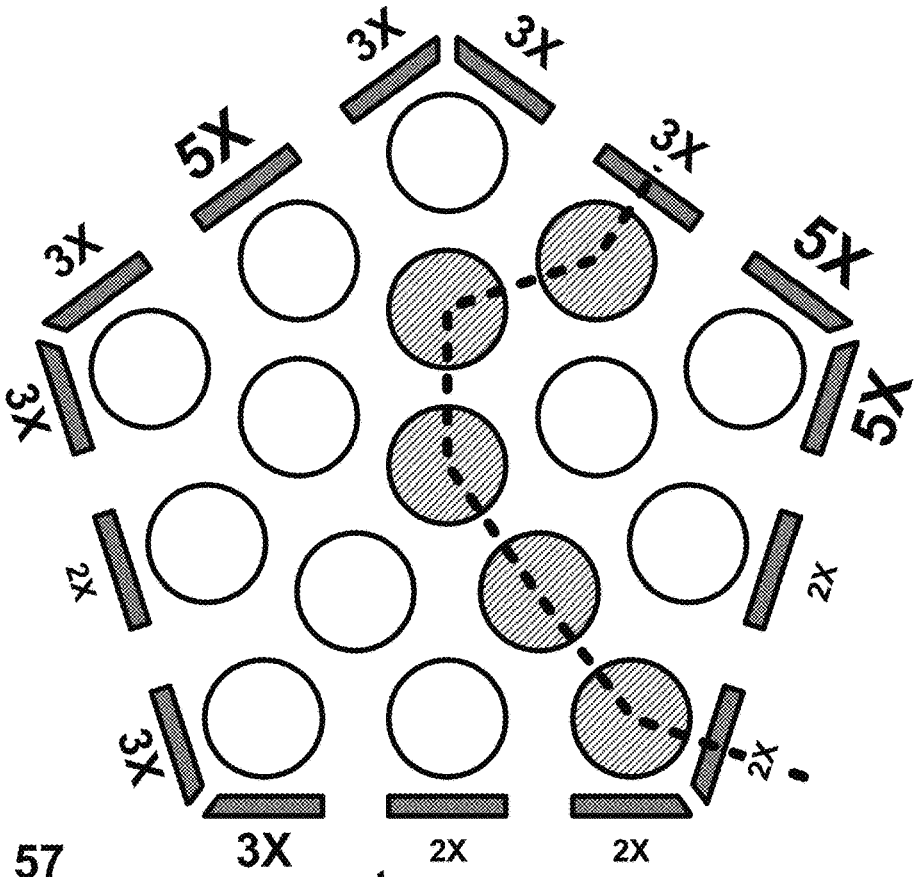
FIGS. 57 and 58 depict an example implementation of a game of chance in which locations about the periphery of the reel layout have bonus multiplier indicators.
Figure 58:
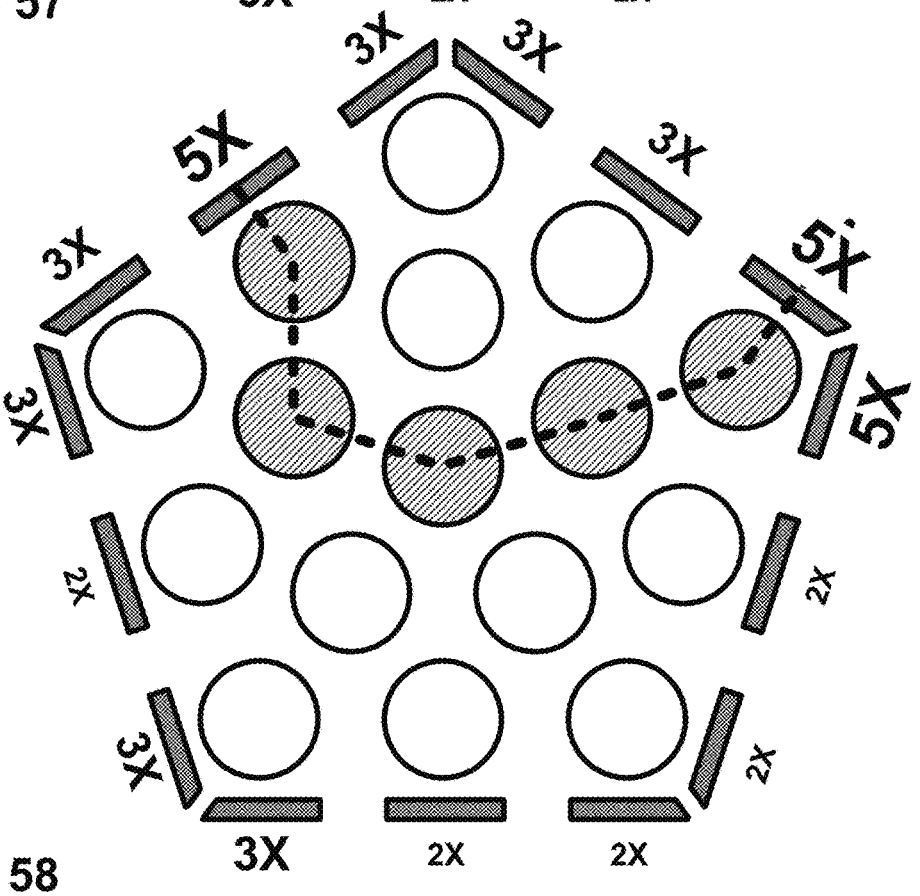

In some implementations with reel stop transformation features, the reel stops may be transformed so as to cause a winning pattern to align with one or more award or prize enhancement features, such as a bonus multiplier. FIGS. 57 and 58 depict an example implementation of a game of chance in which locations about the periphery of the reel layout have bonus multiplier indicators indicating a bonus multiplier that may be applied to a winning pattern along a given payline if that payline starts and ends at locations having the same multiplier effect. Thus, for example, the payline in FIG. 57 that passes through the shaded reel windows (which indicate a winning pattern in this example) would have no multiplier effect applied to the corresponding award since one end of the payline ends at a 2× multiplier and the other ends at a 3× multiplier. However, if the reel stops of the reel layout are rotated by 72 degrees about the center reel window in a counterclockwise direction, this causes the ends of the indicated payline to both align with 5× multipliers, which may cause the award amount for the winning combination to be multiplied by a factor of 5. In other implementations, the multipliers may be replaced or augmented by other types of gameplay enhancements, e.g., free spin awards, bonus game awards, collectible virtual tokens that may be redeemable for additional prizes if a complete set or collection of virtual tokens is obtained, and so forth. In some implementations, only one part of a winning pattern of a payline may need to align with a depicted indicator in order to cause the game enhancing effect to be implemented.

As is apparent from the above discussion and examples, games of chance with transformable reel stops may generally be described as having one or more indicators that may be displayed along one or more edges of a given reel layout or pattern such that each indicator is adjacent to a corresponding location of one of the reel windows in a subset of the reel windows (the subset may be a proper subset, in some implementations, or an improper subset in other implementations). Such indicators may, as discussed above, take the form of indicators indicating a bonus condition or game enhancement or may, as discussed even earlier above, take the form of additional reel windows that may be part of the reel layout or pattern, or part of an adjacent reel layout or pattern.

It is to be understood that the phrase "for each <item> of the one or more <items>," if used herein, should be understood to be inclusive of both a single-item group and multiple-item groups, i.e., the phrase "for . . . each" is used in the sense that it is used in programming languages to refer to each item of whatever population of items is referenced. For example, if the population of items referenced is a single item, then "each" would refer to only that single item (despite the fact that dictionary definitions of "each" frequently define the term to refer to "every one of two or more things") and would not imply that there must be at least two of those items.

The use, if any, of ordinal indicators, e.g., (a), (b), (c) . . . or the like, in this disclosure and claims is to be understood as not conveying any particular order or sequence, except to the extent that such an order or sequence is explicitly indicated. For example, if there are three steps labeled (i), (ii), and (iii), it is to be understood that these steps may be performed in any order (or even concurrently, if not otherwise contraindicated) unless indicated otherwise. For example, if step (ii) involves the handling of an element that is created in step (i), then step (ii) may be viewed as happening at some point after step (i). Similarly, if step (i) involves the handling of an element that is created in step (ii), the reverse is to be understood.

Terms such as "about," "approximately," "substantially," "nominal," or the like, when used in reference to quantities or similar quantifiable properties, are to be understood to be inclusive of values within ±10% of the values or relationship specified (as well as inclusive of the actual values or relationship specified), unless otherwise indicated.

It should be appreciated that all combinations of the foregoing concepts (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

What is claimed is:

1. A system comprising:

one or more displays; and a game controller that includes one or more processors and one or more memory devices, wherein:

the one or more processors, the one or more memory devices, and the one or more displays are operably connected, and the one or more memory devices store computer-executable instructions for controlling the one or more processors to:

cause a plurality of reel windows to be displayed on the one or more displays, each reel window configured to display a reel stop from a corresponding reel having a plurality of reel stops and the plurality of reel windows including a first set of reel windows that are arranged in a first pattern having non-orthogonal radial symmetry about a center axis, wherein there are at least two reel windows in the first set of reel windows arranged along a first axis and two reel windows in the first set of reel windows arranged along a second axis that is not orthogonal to the first axis, select, based on one or more random outcomes generated by a random number generator, a reel stop from each reel to display in the corresponding reel window independent of the outcomes of the reels corresponding to the other reel windows, cause the selected reel stop from each reel to be displayed in the corresponding reel window to form a first reel stop pattern, cause, responsive to receipt of a signal, one or more reel stop rotational shifts to be performed, each reel stop rotational shift including rotationally shifting two or more reel stops about an axis selected from the group consisting of the center axis and one of the axes of radial symmetry of the first pattern, such that the reel stops displayed in at least two non-central reel windows shift to a position in the first pattern occupied by another reel stop, wherein each reel stop that occupies a position in the first pattern to which another one of the reel stops is shifted itself shifts to another position in the first pattern occupied by another one of the reel stops, thereby forming a second reel stop pattern different from the first reel stop pattern and resulting in a higher award amount being presented than would be provided with the first reel stop pattern due, at least in part, to a partial winning pattern in the first reel stop pattern changing to a complete winning pattern in the second reel stop pattern, display one or more winning event patterns in the second reel stop pattern, and present the higher award amount.

2. The system of claim 1, wherein the one or more memory devices further store computer-executable instructions for further controlling the one or more processors to:

identify the one or more winning event patterns by, at least in part, evaluating patterns of reel stops in the second reel stop pattern that are displayed in reel windows that lie along one or more paylines, wherein each payline passes through a different plurality of reel windows and each payline includes a chain of adjacent reel windows.

3. The system of claim 2, wherein:

a second set of reel windows of the plurality of reel windows are arranged in a second pattern having non-orthogonal radial symmetry, the second pattern has an edge that is adjacent to an edge of the first pattern, and a subset of the one or more paylines includes paylines that pass through a chain of adjacent reel windows including at least one reel window in the first set of reel windows and at least one reel window in the second set of reel windows.

4. The system of claim 1, wherein:

the one or more memory devices further store computer-executable instructions for further controlling the one or more processors to cause one or more indicators to be displayed along one or more edges of the first pattern such that each indicator is adjacent to a corresponding location of one of the reel windows in a first subset of the reel windows in the first set of reel windows, and the one or more indicators include at least one score modifier that, when one of the one or more winning event patterns includes the reel stop displayed in the reel window that is adjacent to that score modifier, causes a prize associated with the one winning event pattern that includes the reel stop displayed in the reel window that is adjacent to that score modifier to be increased.

5. The system of claim 4, wherein the one or more memory devices further store computer-executable instructions for further controlling the one or more processors to cause the reel stops displayed in all of the non-central reel windows of the first set of reel windows to rotate about the center axis by the same amount.

6. The system of claim 1, wherein the one or more memory devices further store computer-executable instructions for further controlling the one or more processors to cause reel stops displayed in a plurality of the non-central reel windows of the first set of reel windows to rotate about the center axis by the same amount so that each reel stop displayed in the plurality of non-central reel windows moves to a position occupied by the reel stop displayed in another one of the reel windows of the plurality of non-central reel windows prior to the rotation.

7. The system of claim 1, wherein the one or more memory devices further store computer-executable instructions for further controlling the one or more processors to:

select a bilateral symmetry axis of the first pattern, and cause the reel stops displayed in the reel windows of the first set of reel windows that do not intersect the bilateral symmetry axis to each swap places with the reel stop located the same distance from the bilateral symmetry axis on the opposite side of the bilateral symmetry axis and along an axis that is perpendicular to the bilateral symmetry axis and passes through each swapped pair of reel stops.

8. The system of claim 1, wherein:

the one or more memory devices further store computer-executable instructions for further controlling the one or more processors to cause one or more indicators to be displayed along one or more edges of the first pattern such that each indicator is adjacent to a corresponding location of one of the reel windows in a first subset of the reel windows in the first set of reel windows, and each indicator indicates an enhancement of a prize associated with a winning event pattern that includes the reel stop adjacent to that indicator.

9. The system of claim 1, wherein:

the one or more memory devices further store computer-executable instructions for further controlling the one or more processors to cause one or more indicators to be displayed along one or more edges of the first pattern such that each indicator is adjacent to a corresponding location of one of the reel windows in a first subset of the reel windows in the first set of reel windows, and each indicator is one of the reel windows and at least some of the winning event patterns include the reel stops corresponding with the reel windows that are indicators.

10. The system of claim 1, wherein the signal is indicative of a player input to the system.

11. The system of claim 1, wherein the one or more memory devices further store computer-executable instructions for further controlling the one or more processors to:

determine that the first reel stop pattern includes the partial winning pattern and that performing the one or more reel stop rotational shifts to form the second reel stop pattern different from the first reel stop pattern will cause the partial winning pattern to turn into the complete winning pattern that results in the higher award amount being presented, and cause the signal to be generated responsive to determining that the first reel stop pattern includes the partial winning pattern and that performing the one or more reel stop rotational shifts to form the second reel stop pattern will cause the partial winning pattern to turn into the complete winning pattern that results in the higher award amount being presented.

12. The system of claim 1, wherein the one or more memory devices further store computer-executable instructions for further controlling the one or more processors to:

determine a number of transformation chances associated with a given player;

determine that the first reel stop pattern includes the partial winning pattern and that performing the one or more reel stop rotational shifts to form the second reel stop pattern different from the first reel stop pattern will cause the partial winning pattern to turn into the complete winning pattern that results in the higher award amount being presented, provide the given player with an opportunity to redeem one or more of the number of transformation chances associated with the given player to cause the one or more reel stop rotational shifts to be performed to form the second reel stop pattern, and cause the signal to be generated responsive to receiving an input indicating the redemption of the one or more transformation chances.

13. The system of claim 1, wherein the one or more memory devices further store computer-executable instructions for further controlling the one or more processors to:

identify the one or more winning event patterns by, at least in part, evaluating patterns of reel stops that are displayed in reel windows located in locations non-adjacent to one another.

14. The system of claim 1, wherein the first pattern has N-fold radial symmetry, wherein N is a value selected from the group consisting of: 3, 5, 6, and 7.

15. The system of claim 14, wherein each payline includes N or less reel windows.

16. The system of claim 14, wherein each payline includes N reel windows.

17. The system of claim 14, wherein each payline passes through the same number of reel windows.

18. A method comprising:

causing a plurality of reel windows to be displayed on one or more displays of a gaming machine, each reel window configured to display a reel stop from a corresponding reel having a plurality of reel stops and the plurality of reel windows including a first set of reel windows of the plurality of reel windows are arranged in a first pattern having non-orthogonal radial symmetry about a center axis, wherein there are at least two reel windows in the first set of reel windows arranged along a first axis and two reel windows in the first set of reel windows arranged along a second axis that is not orthogonal to the first axis;

selecting, based on one or more random outcomes generated by a random number generator, a reel stop from each reel to display in the corresponding reel window independent of the outcomes of the reels corresp onding to the other reel windows;

causing the selected reel stop from each reel to be displayed in the corresponding reel window to form a first reel stop pattern;

causing, responsive to receipt of a signal, one or more reel stop rotational shifts to be performed, each reel stop rotational shift including rotationally shifting two or more reel stops about an axis selected from the group consisting of the center axis and one of the axes of radial symmetry of the first pattern, such that the reel stops displayed in at least two non-central reel windows shift to a position in the first pattern occupied by another reel stop, wherein each reel stop that occupies a position in the first pattern to which another one of the reel stops is shifted itself shifts to another position in the first pattern occupied by another one of the reel stops, thereby forming a second reel stop pattern different from the first reel stop pattern and resulting in a higher award amount being presented than would be provided with the first reel stop pattern due, at least in part, to a partial winning pattern in the first reel stop pattern changing to a complete winning pattern in the second reel stop pattern;

displaying one or more winning event patterns in the second reel stop pattern; and presenting the higher award amount.

19. A non-transitory, computer-readable medium storing machine-readable and executable instructions for controlling one or more processors to cause the one or more processors to:

cause a plurality of reel windows to be displayed on one or more displays of a gaming machine, each reel window configured to display a reel stop from a corresponding reel having a plurality of reel stops and the plurality of reel windows including a first set of reel windows that are arranged in a first pattern having non-orthogonal radial symmetry about a center axis, wherein there are at least two reel windows in the first set of reel windows arranged along a first axis and two reel windows in the first set of reel windows arranged along a second axis that is not orthogonal to the first axis;

select, based on one or more random outcomes generated by a random number generator, a reel stop from each reel to display in the corresponding reel window independent of the outcomes of the reels corresponding to the other reel windows;

cause the selected reel stop from each reel to be displayed in the corresponding reel window to form a first reel stop pattern;

cause, responsive to receipt of a signal, one or more reel stop rotational shifts to be performed, each reel stop rotational shift including rotationally shifting two or more reel stops about an axis selected from the group consisting of the center axis and one of the axes of radial symmetry of the first pattern, such that the reel stops displayed in at least two non-central reel windows shift to a position in the first pattern occupied by another reel stop, wherein each reel stop that occupies a position in the first pattern to which another one of the reel stops is shifted itself shifts to another position in the first pattern occupied by another one of the reel stops, thereby forming a second reel stop pattern different from the first reel stop pattern and resulting in a higher award amount being presented than would be provided with the first reel stop pattern due, at least in part, to a partial winning pattern in the first reel stop pattern changing to a complete winning pattern in the second reel stop pattern;

display one or more winning event patterns in the second reel stop pattern; and present the higher award amount.

20. The non-transitory, computer-readable medium of claim 19, wherein:

the first pattern has N-fold radial symmetry, and

N is a value selected from the group consisting of: 3, 5, 6, and 7.

* * * * *